US006187394B1

(12) United States Patent
Johnson et al.

(10) Patent No.: US 6,187,394 B1
(45) Date of Patent: Feb. 13, 2001

(54) LIQUID FILLED BUBBLING DISPLAY

(76) Inventors: John C. Johnson; George S. Johnson, both of 10804 Dobbs Ct., Charlotte, NC (US) 28277

( * ) Notice: Under 35 U.S.C. 154(b), the term of this patent shall be extended for 0 days.

(21) Appl. No.: 08/896,492

(22) Filed: Jul. 17, 1997

(51) Int. Cl.[7] ..... G09F 19/00

(52) U.S. Cl. ..... 428/13; 40/406; 40/407; 40/439; 40/441; 119/245; 119/248; 119/254; 119/255

(58) Field of Search ..... 428/13; 40/406, 40/407, 439, 441; 119/245, 248, 254, 255

(56) References Cited

U.S. PATENT DOCUMENTS

| | | | | |
|---|---|---|---|---|
| D. 348,535 | * | 7/1994 | Burnett | D26/93 |
| 1,926,240 | * | 9/1933 | Maas | 62/441 X |
| 2,072,841 | * | 3/1937 | Tracey et al. | 40/407 |
| 2,278,383 | * | 3/1942 | Rosenblatt | 40/406 |
| 2,638,261 | * | 5/1953 | Poole | 229/5.5 |
| 3,101,564 | * | 8/1963 | Stoessel | 40/407 |
| 3,271,881 | * | 9/1966 | Wagnon | 40/408 X |
| 3,332,433 | * | 7/1967 | Edmondson | 137/215 |
| 3,355,056 | * | 11/1967 | Fisch | 362/92 |
| 3,499,238 | * | 3/1970 | Publicker | 40/406 |
| 3,613,264 | * | 10/1971 | Vitka et al. | 434/126 |
| 3,711,698 | * | 1/1973 | Hess | 40/407 |
| 3,749,424 | * | 7/1973 | Greene | 285/139.1 |
| 3,762,083 | * | 10/1973 | Lemons et al. | 40/560 |
| 3,964,194 | * | 6/1976 | Gugeler | 40/406 |
| 4,190,312 | * | 2/1980 | Bailey | 362/96 X |
| 4,208,848 | * | 6/1980 | Kohl | 52/171.3 |
| 4,265,402 | * | 5/1981 | Tsai | 239/20 |
| 4,352,149 | * | 9/1982 | Stetler | 362/96 |
| 4,498,692 | * | 2/1985 | Swanson | 285/20 |
| 4,686,784 | * | 8/1987 | Smithies | 40/406 |
| 4,900,068 | * | 2/1990 | Law | 285/139.2 |
| 4,939,859 | * | 7/1990 | Brant | 40/406 |
| 4,974,127 | * | 11/1990 | Foley | 362/96 |
| 5,018,288 | * | 5/1991 | Yang | 40/406 |
| 5,037,140 | * | 8/1991 | Anderson | 285/139.2 |
| 5,106,660 | * | 4/1992 | Vorel | 428/13 |
| 5,167,993 | * | 12/1992 | Aoyagi | 428/34 |
| 5,340,024 | * | 8/1994 | Fuller et al. | 239/17 |
| 5,349,771 | * | 9/1994 | Burnett | 40/406 |
| 5,416,994 | * | 5/1995 | McLaughlin | 40/406 |
| 5,426,878 | * | 6/1995 | Branson | 40/409 |

FOREIGN PATENT DOCUMENTS

2393385 * 2/1979 (FR) .

* cited by examiner

*Primary Examiner*—Timothy M. Speer
*Assistant Examiner*—Bryant Young
(74) *Attorney, Agent, or Firm*—Gary L. Eastman, Esq.

(57) ABSTRACT

The present invention of a Bubbling Liquid Display includes a variable-pressure air source which injects air into a liquid within a panel at variable flow rates into an number of individual chambers to create a unique bubbling pattern for each chamber which includes large bubbles which move upwards within the fluid in the display, and smaller bubbles which move downwards within the fluid in the display. The display may be drained a single chamber at a time, eliminating the need to completely drain the display for maintenance, and also is substantially leak-proof, despite being tipped or knocked over. The display incorporates a fluid which resists evaporation, corrosion, and algae formation, despite being constantly bubbled or exposed to sunlight or other sources of heat, and which may be effectively recirculated through the display. The display is also adaptable to retrofit vending machines, as well as a variety of other useful items, such as point-of-purchase displays and wall-hangings.

15 Claims, 22 Drawing Sheets

LIQUID FILLED BUBBLING DISPLAY

BACKGROUND OF THE INVENTION

1. Field of the Invention

The present invention relates generally to bubbling liquid displays. More specifically, the present invention relates to a bubbling liquid display which includes a transparent panel formed to contain a quantity of liquid into which air is introduced, forming bubbles in the liquid and creating a unique and extraordinary visual effect.

2. Description of Related Art

Bubbling water panels have, in recent years, been incorporated into a variety of devices. Perhaps one of the most common such devices is a water panel that is used as an attention-grabbing display, such as those used in the retail market to call attention to a particular product or service. For example, a typical prior art water panel is disclosed in U.S. Pat. No. 5,106,660 which issued Apr. 21, 1992 to Mark Vorel for an invention entitled "Decorative Wall Panel." The Vorel device consists of two transparent glass sheets which are attached along their side and bottom edges to spacers to form a reservoir. This reservoir is filled with water and a bubble-emitting diffuser tube is positioned at the lower end of the reservoir which, when supplied with pressurized air, creates many fine bubbles which rise through the fluid within the reservoir. The diffuser tube is attached to a supply tube which extends upwards out the top of the reservoir so that there is no inlet tube or other hole formed in the lower, or water-filled, portion of the panel. However, because the supply tube extends downwards from the top to the bottom of the panel, it is visible to the viewer of the panel unless the side portions of the panel are covered. Also, a light is provided in the base which holds the panel to illuminate the panel and the rising bubbles.

Another prior art water panel is disclosed in U.S. Pat. No. 5,349,771 which issued on Sep. 27, 1994, to Kenneth Burnett for an invention entitled "Rising Bubble Display Device." The Burnett device includes a water panel which has a number of vertical ribs defining water-filled channels. An air supply tube extends along the inside edge of the bottom of the panel, passing beneath the lower end of each vertical rib. The air supply tube is formed with an array of bubble-producing orifices such that one bubble-producing orifice is positioned within each channel, providing each channel with one orifice producing the same volume of air. Unfortunately, these bubble-producing orifices are small, typically sized in the 0.61 mm range. During an extended period of use, these small orifices often become clogged with corrosion, salts, or algae from the water, resulting in a water-filled channel having no bubbles at all.

Because of the frequent clogging of the air supply tube, the tube is removable by un-threading the tube from the side wall of the panel. A seal is provided around the air supply tube at its entrance to the water panel to prevent leaks while the air supply tube is installed. However, these seals are inherently problematic and often results in leaks, which may cause the entire volume of water within the panel to escape onto the electrical components within the base and onto the floor.

The water panel of the Burnett device is formed at its lower end with a box channel sized to receive a colored strip which, when illuminated from underneath, provides coloring to the liquid and bubbles within the water panel. This combination of a box channel and colored strip, however, only provides coloring to the illumination of the contents of the panel, yet does not provide any colored illumination of the front and back sheets of the panel itself. This causes the front and back acrylic sheets to be illuminated by non-colored (or white) light, while the bottom of the panel and the liquid contained therein are illuminated by colored light. As a result, the overall coloring of the water panel is considerably less intense than if the entire panel, including the front and back sheets, were illuminated with the colored light.

The installation of the strip into the box channel formed in the Burnett panel is both cumbersome and problematic. For example, the colored strip, most often made of a thin translucent plastic material, must be inserted into the box channel formed in the panel by sliding the thin, narrow plastic sheet axially into the channel. Unfortunately, due to its shape and material, the colored strip is quite flexible, resulting in the user experiencing significant difficulty while attempting to slide the strip into the box channel, which extends across the entire width of the water panel. Further, when the colored strip becomes damaged, such as by heat from the lights or by exposure to water caused from a leaking supply tube seal, portions of the colored strip become stuck within the box channel. Often, it is nearly impossible to remove the stuck portions of the colored strip from the channel, resulting in a display device having little or no coloring. Moreover, in the Burnett device, it is impossible to simultaneously provide more than one colored illumination to the panel. This is so because the colored strip may only be inserted from the sides of the panel, preventing the placement of shorter, different colored, color strips within the box channel.

Maintenance of a water panel is generally difficult. For example, in attempting to maintain the Burnett device, it is necessary to drain the entire water panel before servicing the air supply tube, or to repair or unclog a single orifice. While not impossible, draining the entire volume of water from the panel may take quite some time, result in a great deal of wasted water, and often represents a significant deterrent to the performance of necessary maintenance.

The prior art water panels of the Vorel and Burnett devices are generally shaped as flat panels with the front and back sheets of transparent material joined at the bottom, left and right sides to form a water-holding reservoir. While this structure provides for the easy filling and refilling of the panel through its open upper end, the entire volume of the water panel will easily pour out the top of the panel if the panel somehow tips or falls over. Moreover, because the water in the panel is constantly bubbling with air bubbles, a great deal of the volume of water within the panel evaporates. Attempts to minimize the chances of spillage and evaporation by placing a creatively-shaped lid over the top of the panel are, at best, of little value. This is so because in the event the panel tips or falls, the lid simply falls from the panel allowing the entire volume of water within the panel to escape onto the floor or carpet, neighboring appliances, and other electrical devices.

The prior art water panels are filled with water as the fluid. Typically, distilled water is used in order to minimize the corrosion and salt deposits which were discussed above. However, this water evaporates from the panel due to the constant passage of air bubbles through it, resulting in water levels which are too low, and which are no longer hidden from view by the panel's cap. Moreover, if the climate is particularly dry, or the panel is in a location where it is exposed to sunlight, the evaporation may be quite significant, resulting in the user having to continually refill the panel.

The formation of algae is common in water panels and is due to the confined water, constant air source, retained heat, and the inability to easily scrub any algae from the interior surfaces of the panel. Many water panel manufactures suggest the addition of chlorine to the distilled water in an attempt to minimize the formation of the algae. The use of such chemicals, however, is inherently problematic when used with acrylic panels, often causing discoloration and cracking of the acrylic. Consequently, presently available water panels have a constant problem with algae formation.

As a result of the above, a need remains for a Bubbling Liquid Display which is easy to use and maintain, safer to operate, provides a unique visual bubbling effect, is uniformly lighted, virtually leak-proof, and comparatively cost effective.

SUMMARY OF THE INVENTION

Accordingly, it is an advantage of the present invention to provide a Bubbling Liquid Display which includes a variable-pressure air source which injects air into the liquid within the display at variable flow rates;

It is another advantage of the present invention to provide a Bubbling Liquid Display which includes two or more isolated and distinct chambers to hold a quantity of fluid;

It is another advantage of the present invention to provide a Bubbling Liquid Display which provides for the user of a Display to selectively alter the quantity of bubbles in each individual chamber to create a unique bubbling pattern for each chamber.

It is a further advantage of the present invention to provide a Bubbling Liquid Display which includes a means to create large bubbles which move upwards within the fluid in the Display, while also creating smaller bubbles which move downwards within the fluid in the Display.

It is yet another advantage of the present invention to provide a Bubbling Liquid Display which incorporates a translucent colorizing sheet for the colored illumination of the entire panel.

It is a further advantage of the present invention to provide a Bubbling Liquid Display which incorporates a translucent colorizing sheet which is easy to install and remove from the Display.

It is a further advantage of the present invention to provide a Bubbling Liquid Display which is formed to incorporate a plurality of translucent colorizing sheets to create a variable coloring of the Display;

It is another advantage of the present invention to provide a Bubbling Liquid Display which may be drained a single chamber at a time, eliminating the need to completely drain the Display for maintenance.

It is yet another advantage of the present invention to provide a Bubbling Liquid Display which resists leakage and spillage, despite being tipped or knocked over.

It is still another advantage of the present invention to provide a Bubbling Liquid Display which incorporates a fluid which resists evaporation, corrosion, and algae formation, despite being constantly bubbled or exposed to sunlight or other sources of heat.

It is another advantage of the present invention to provide a Bubbling Liquid Display which incorporates an air recycling system that further minimizes evaporation, corrosion, and algae formation.

It is another advantage of the present invention to provide a Bubbling Liquid Display which injects a bubble creating gas into a fluid that further minimizes evaporation, corrosion, and algae formation, and decreases the need for replacing or treating the fluid.

It is yet another advantage of the present invention to provide a Bubbling Liquid Display which incorporates a means for selectively varying the intensity of the illumination of each of the chambers within the Display.

It is another advantage of the present invention to provide a Bubbling Liquid Display which incorporates an overflow basin which, despite leakage of the chambers, prevents any fluid from exiting the display or coming in contact with any electrical components of the Display.

It is another advantage of the present invention to provide a Bubbling Liquid Display which includes a removable drawer to facilitate the maintenance, repair, and use of the Display while providing the highest degree of safety.

It is yet another advantage of the present invention to provide a Bubbling Liquid Display which is constructed in such a manner so as to allow the interchangeability of water-filled panels and bases to assemble a variety of Displays having different visual characteristics.

Additional features and advantages of the present invention are set forth in the description which follows, and in part will be apparent from the description, or may be learned by practice of the invention. The objectives and other advantages of the invention will be realized and attained by the apparatus and method particularly pointed out in the written description and claims hereof, as will as the appended drawings.

To achieve the above advantages, and in accordance with the purpose of the invention, as embodied and described broadly herein, the invention comprises a Bubbling Liquid Display having unique features creating distinct bubbling patterns and coloring and which give rise to a superior display having extraordinary aesthetic appeal. The Bubbling Liquid Display includes a liquid filled panel which contains at least one fluid-filled chamber. This panel is formed of two planar sheets of transparent material, attached to walls at their side edges and a bottom plate at their bottom edge to form a water-tight chamber with an open upper end. Additional chambers may be created within the panel by placement of one or more ribs extending vertically from the upper end of the panels to bottom end of the panels. Also, the upper end of the panel may be sealed by a top plate and provided with a exhaust fitting, or anti-siphon valve, which is sealable to prevent leakage of fluid from within the individual chamber when the panel is tipped.

The panel attaches to a base by bolting the bottom plate of the panel to the base. The bottom plate of the base is equipped with a pair of spacers, one on the underside of each end of the bottom plate, to create a gap between the base and the bottom plate of the panel which allows placement of one or more colorizing sheets between the base and the panel.

The base also includes a variable illumination source which will provide illumination intensities selectable between zero and several hundred watts. Moreover, it is possible to provide different illumination intensities between neighboring chambers, resulting in an ability to create unusual lighting combinations.

Also included in the base is one or more variable pressure air sources, typically of an air-compressor type, which allows the user to selectively alter the quantity and intensity of bubbles in the display. Moreover, it is possible to control the bubble intensity of each chamber individually, resulting in a multi-chamber panel having different bubble intensities in each chamber. This bubble selectivity, in combination with the variable illumination, provides for a truly unique visual effect.

To minimize any necessary maintenance on the Bubbling Display Panel, the present invention includes a fluid which resists evaporation. Specifically, polypropylene glycol is used, either alone or in combination with water, to provide a fluid which resists evaporation, contamination, and corrosion. Coloring may be added to the water, and/or polypropylene glycol, to provide for coloring of the fluid within the display.

In an additional effort to minimize evaporation and corrosion, the display may include a recirculation system which will recirculate the gases from the exhaust of each chamber back to the base for recirculation through the fluid. This will minimize any fluid loss due to evaporation, and will also facilitate the utilization of gases other than air, such as ozone, nitrogen or carbon-dioxide, for introduction into the fluid to form the bubbles. These gases, in combination with the polypropylene glycol, will significantly deter any corrosion and algae formation in the display, effectively eliminating any necessary periodic maintenance.

The addition of a top plate to the upper end of the panel minimizes any leakage from the panel when tipped. Nonetheless, to prevent spillage of any fluid in the unlikely event of a failure of one or more chambers, the base is equipped with an overflow basin which is sized to contain the entire fluid volume of the panel, and maintain that fluid volume separate from any other components of the display. This eliminates any danger of exposing the electrical and mechanical components of the display to the leaking fluid.

To facilitate the manufacturing, repair and replacement of components of the Bubbling Liquid Display, the base is equipped with a removable drawer which includes a safety interlock switch to prevent energizing of the electrical components of the display without the drawer being fully inserted into the base. By removing the drawer from the base, all components of the display device may be easily inspected, repaired or replaced.

As mentioned above, the lower end of each panel is equipped with a bottom plate. These bottom plates may be formed with mounting holes which are placed in controlled locations, thus allowing the different panels to be mounted on one base. This results in the ability of a user to purchase one base, and periodically alternate between several panels to provide a changing display.

If desired, one or more removable colorizing sheets may be easily placed in the gap between the panel and the base. This colorizing sheet will provide superior colored illumination of the entire water panel, including the front and rear face of the panel.

In an alternative embodiment, a Bubbling Liquid Display is provided which is formed to include a "U-tube" which, despite the failure of the air pump, check valves, or any other safety devices, will not leak any fluid from the chamber. The "U-tube" may be formed within the side members and/or ribs of the panel, and consists of two vertical pipes, or tubes, which are attached together at their upper ends. The lower end of one vertical tube is attached to an air source, such as a pump. The lower end of the other vertical tube is attached to the gang valves for distribution of the supplied air to the various chambers. Because the "U-tube" extends above the level of the fluid within the chambers, gravity will prevent the flow of fluid from the chambers, through any valves, and up through the "U-tube".

In another alternative embodiment, a Bubbling Liquid Display is provided which includes a quantity of reflective particles which increases the viewability of the Display when exposed to intense light, such as when the unit is placed in direct sunlight. These particles are neutrally buoyant and are easily moved about the fluid filled chambers by the natural movement of the bubbles. These reflective particles are metallized plastic, making them rust-resistant, and may be formed in a variety of shapes to provide an additional visual effect.

In yet another alternative embodiment, a leak-proof Bubbling Liquid Display is provided which includes both an adjustable air supply path and air recovery path formed within the acrylic panel material itself. The air supply system includes a "U-tube" which provides the leak-proof feature by requiring air to flow higher than gravity will permit in order to escape the chamber. In the upper portion of a Display, the air supply channels for each individual chamber is equipped with an adjustment knob which will adjust the flow of air therethrough to decrease or increase the flow of the air into the chamber. At the upper end of each chamber, a vent hole is formed which is in communication with a collection tube joining all vent holes for communication out of the panel. The collection tube may be routed to the lower end of the panel through a side member, to provide both the air inlet and air outlet in the bottom edge of the panel.

In another alternative embodiment, a Bubbling Liquid Display is provided which incorporates a vending machine. The vending machine is equipped with a replaceable front panel which is easily replaced with a Display having a variety of shapes and contours. Specifically, a vending machine may be equipped with a front panel including a three-dimensional object, such as a soda bottle, which would incorporate a shaped water panel. Alternatively, the front panel of a vending machine may be equipped with a substantially flat panel, having an etched front surface, or the panel may be partially covered with an artistic or promotional overlay, such as a photograph of a soda-filled glass, with the photograph having clear portions where it is desired that the bubbles within the panel be visible.

In another alternative embodiment, a Bubbling Liquid Display is provided which incorporates a point-of-purchase device. The Display includes a substantially cylindrical double-walled panel which is partially hollowed, and may be filled with an object for sale, such as a collection of soda bottles surrounded by ice.

In yet another alternative embodiment, a Bubbling Liquid Display is provided which is incorporated into a refrigerator, such as those having glass doors and often filled with refreshments, including sodas, beer, etc. Instead of having glass within the doors of the refrigerator, each door is equipped with a Display such that the contents of the refrigerator are viewable by looking through the doors, providing a "bubbly" view of the refreshments.

BRIEF DESCRIPTION OF THE DRAWINGS

Understanding the present invention will be facilitated by consideration of the following detailed description of some preferred embodiments of the present invention taken in conjunction with the accompanying drawings, in which like numerals refer to lake parts, and in which.

DESCRIPTION OF THE PREFERRED EMBODIMENT

Figure 1:
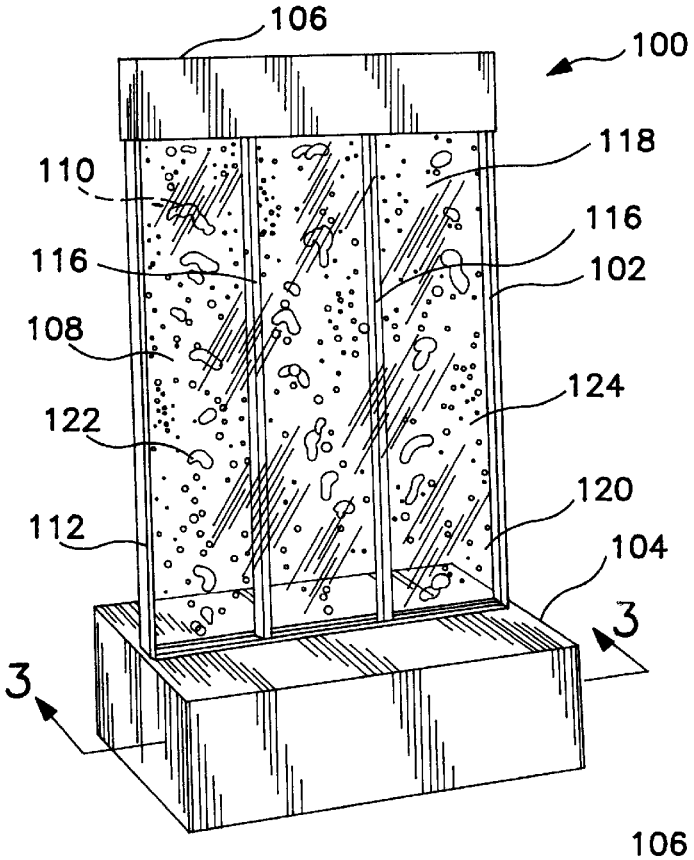
FIG. 1 is a perspective view of a Bubbling Liquid Display showing a panel having three chambers, supported by a base, and topped with a cap.

Referring now to FIG. 1, a Bubbling Liquid Display is shown in perspective and generally designated 100. Display 100 includes a panel 102, a base 104 and a cap 106. Panel 102 is formed from a transparent material, preferably acrylic, and most preferably polymethyl methacrylate. The panel 102 includes a front sheet 108, back sheet 110, two side sheets 112, and a bottom plate 114 (concealed in this Figure by base 104). Panel 102 may also be equipped with one or more ribs 116 to define chambers 118.

Base 104 is sized to provide stability to the panel as it extends upwards, but otherwise its dimensions are not critical. As will be discussed below, most components of the Bubbling Liquid Display are contained within the base 104. Cap 106 is sized to slide over the outside of panel 102, and is removable simply lifting upwards on the cap to separate it from the panel.

Figure 2:
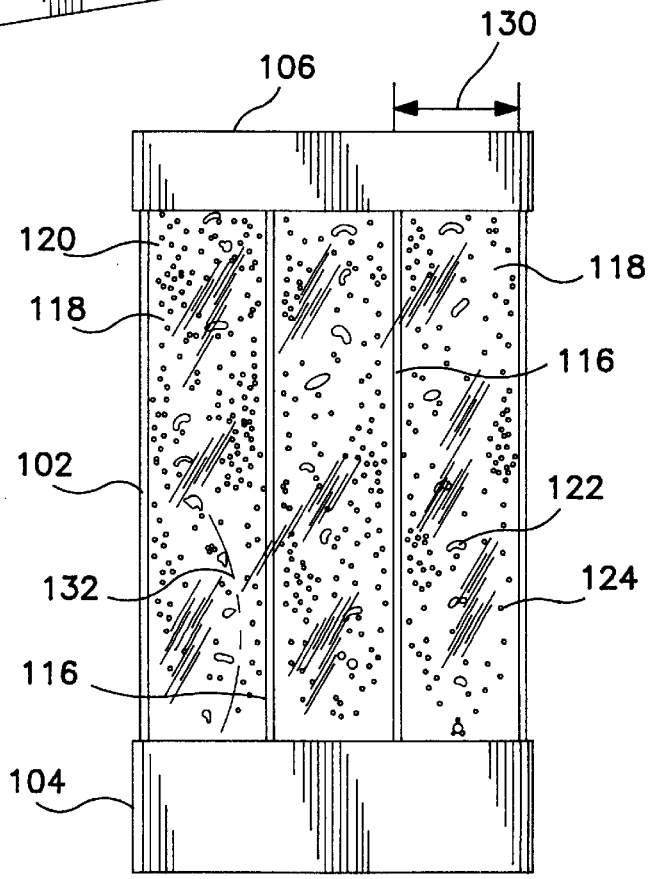
FIG. 2 is a front view of the Bubbling Liquid Display of FIG. 1, showing large and small bubbles forming a distinct bubble pattern having a generally sinusoidal curvature.

Referring now to FIG. 2, the Bubbling Liquid Display 100 of FIG. 2 is shown in a front view. Display 100 is shown to be filled with a fluid 120 and includes a variety of bubbles. Specifically, Display 100 includes larger bubbles 122 and smaller bubbles 124.

Figure 3:
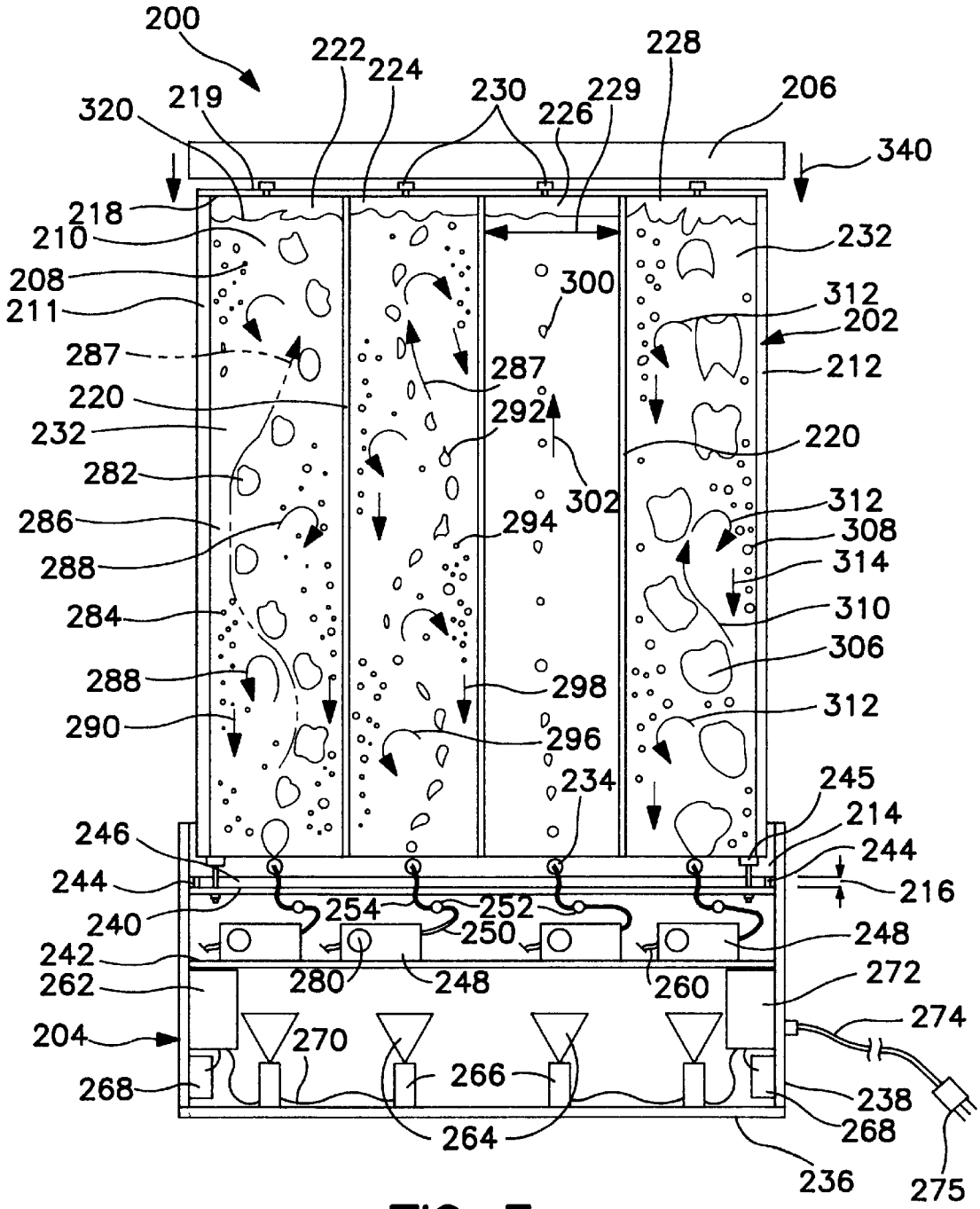
FIG. 3 is a partial cross-sectional view of a Bubbling Liquid Display similar to FIGS. 1 and 2, yet having four chambers each with its own distinct bubble intensity and curvature, and showing the base in cross-section.

Referring now to FIG. 3, a Bubbling Liquid Display similar to FIGS. 1 and 2, yet having four chambers, is shown in partial cross-section, and generally designated 200. Display 200 includes a panel 202, a base 204, and a cap 206, shown separated from panel 202 for clarity. Panel 202 includes front sheet 208, back sheet 210, left side 211, and right side 212, which are typically acrylic, and are glued together using an adhesive, preferably a dichloromethane adhesive selected for compatibility with the acrylic. The lower end of the panel 202 is sealed with a bottom plate 214 which is considerably thicker than the front, back and side sheets of the panel, the bottom plate typically having a thickness 216 ranging from about a 3/16 to 1.0 inches, preferably 0.5 inches. Bottom plate 214 is sized to extend outside of the footprint of the panel 202 on its front, back, and sides. This provides for a vertical stability of the panel, and also provides a locations for mounting the panel 202 to the base 204.

The upper edge 218 of panel 202 may be sealed with a top 219. Panel 202 may also include a number of ribs 220 which extend from the upper edge 218 of panel 202 down to the bottom plate 214, to provide distinct chambers. In the present embodiment, display 200 includes three ribs 220 which form four chambers. Specifically, first chamber 222, second chamber 224, third chamber 226, and fourth chamber 228 are formed in panel 202 to and combine with bottom plate 214 and top 219 to provide four distinct and separate chambers, each equipped with its own filling and exhaust port 230. Each of the chambers, being distinct from the other chambers, contains a quantity of fluid 232 which will not flow between chambers.

Base 204 is formed by a bottom 236 and sides 238, and also includes an upper shelf 240 and a lower shelf 242, each held in place against sides 238 by support bars (not shown in this Figure) which attached to the sides 238. Panel 202 is attached to base 204 by bolting, or otherwise attaching, bottom plate 214 to upper shelf 240. Spacers 244 are provided between the bottom plate 214 and upper shelf 240 to establish a gap 246 between the upper shelf and the bottom plate. The spacers 244 are sufficiently thick to create a gap 246 which is large enough to insert a colorizing sheet 247 therein. Lower shelf 242 of base 204 contains pumps 248 which provide pressurized air through tube 250, through gang valve 252, through tube 254, through air inlets 234 formed in bottom plate 214, and into the chambers 222, 224, 226, 228. While the details of the air supply will be covered in depth in conjunction with FIGS. 5 and 6, it is important to notice that base 202 is equipped with four pumps 248, with each pump supplying air to only one chamber. However, pumps 248 are preferably model BP 101-1 available from Binaca Products, which are adjustable using adjustment 280, and are capable of delivering a sufficient quantity of air to provide bubbles to all four chambers with a single pump, provided the tubes 250 and 254 are re-routed to feed from one pump, as is well known in the art.

Figure 7:
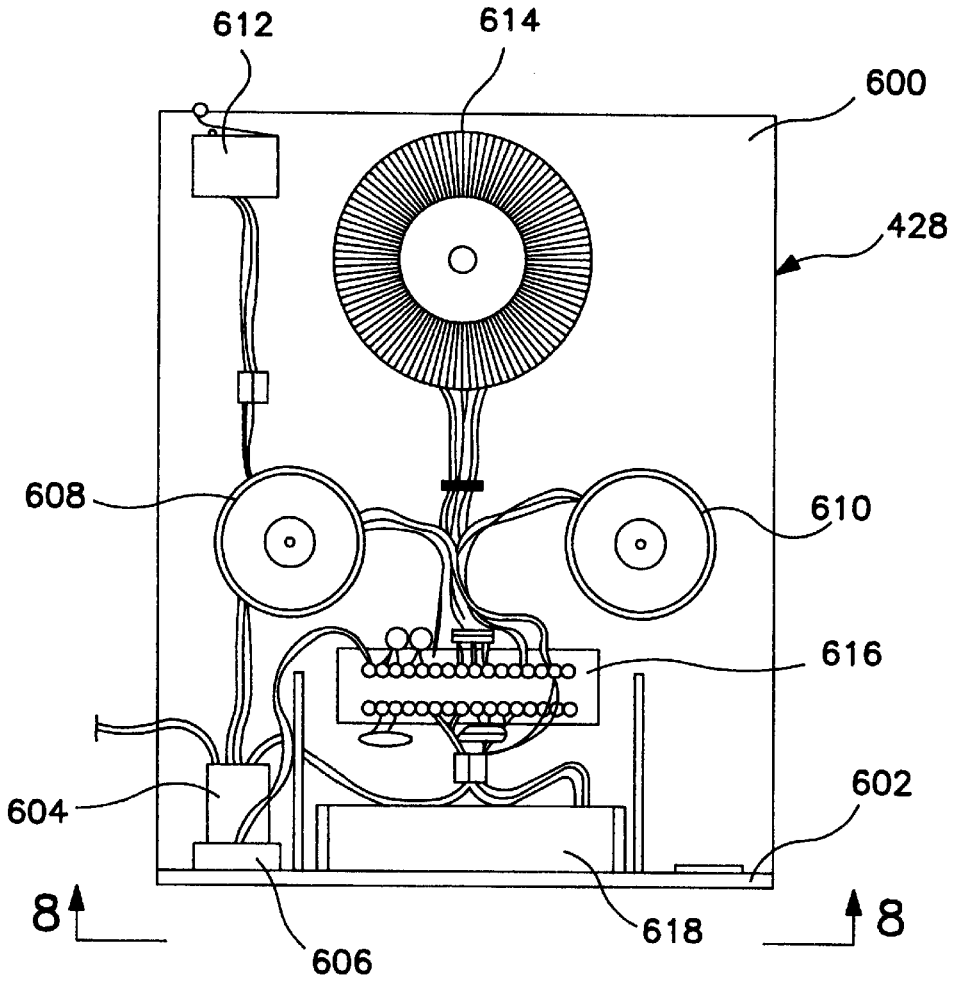
FIG. 7 is a top view of the drawer as shown removed from a Bubbling Liquid Display, showing relative placement of the transformer, illumination sources, illumination intensity control (dimmer), safety interlock switch, fan, and the AC input module.
Figure 8:
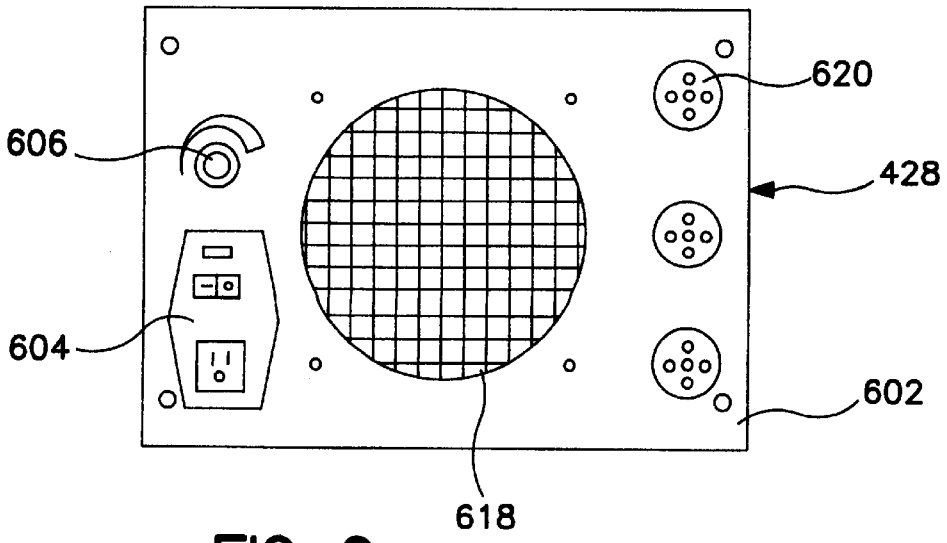
FIG. 8 is a front view of the drawer showing relative placement of the fan, dimmer control knob, air vents, and AC input module.

Also included in base 204 is an electrical boxes 262 which contains much of the electrical circuitry necessary to operate and control the Display 200. The details of the electrical circuitry will be discussed in conjunction with FIGS. 7, 8 and 9, however, from this Figure, lamps 264 held in bases 266, and fans 268, are shown electrically connected to box 262 via wiring 270. The connection of electrical cords 260 from pumps 248 has been omitted from this figure, but it is to be understood that such connections are made within electrical boxed 262, 272. Base 204 may be equipped with a second electrical box 272 which could control additional lamps, but such redundancy is not necessary, and may simply be included for manufacturing simplification. Electrical cord 274 provides the electrical connection to the Display 200, and may be equipped with a Ground Fault Circuit Interrupt (GFCI) plug 275 intended to eliminate any hazards of shock or fire. Alternatively, the GFCI may be contained with base 202 to achieve the same safety benefit.

As shown, Display 200 is formed with four chambers 222, 224, 226, 228 which are located immediately above light lamps 264. It should also be noted that bottom shelf 242 may be formed with a cut-out portion (not shown) in its center to allow the full power of the light generated by lamps 264 to strike the lower surface of upper shelf 240. Upper shelf 240 is made from a transparent acrylic such that substantially all light which strikes upper shelf 240 is transmitted through the upper shelf, across gap 246, through bottom plate 214, and into panel 202 and fluid 232. Preferably, lamps 264 are low voltage, high intensity halogen lamps, such as model number CEW75WMR16 available from CEW Lighting Products, and can provide an illumination of approximately 13,500 Candela. Importantly, the intensity of each of these lamps may be controlled individually, or jointly, so that each chamber may be provided with its own intensity of light.

Figure 17:
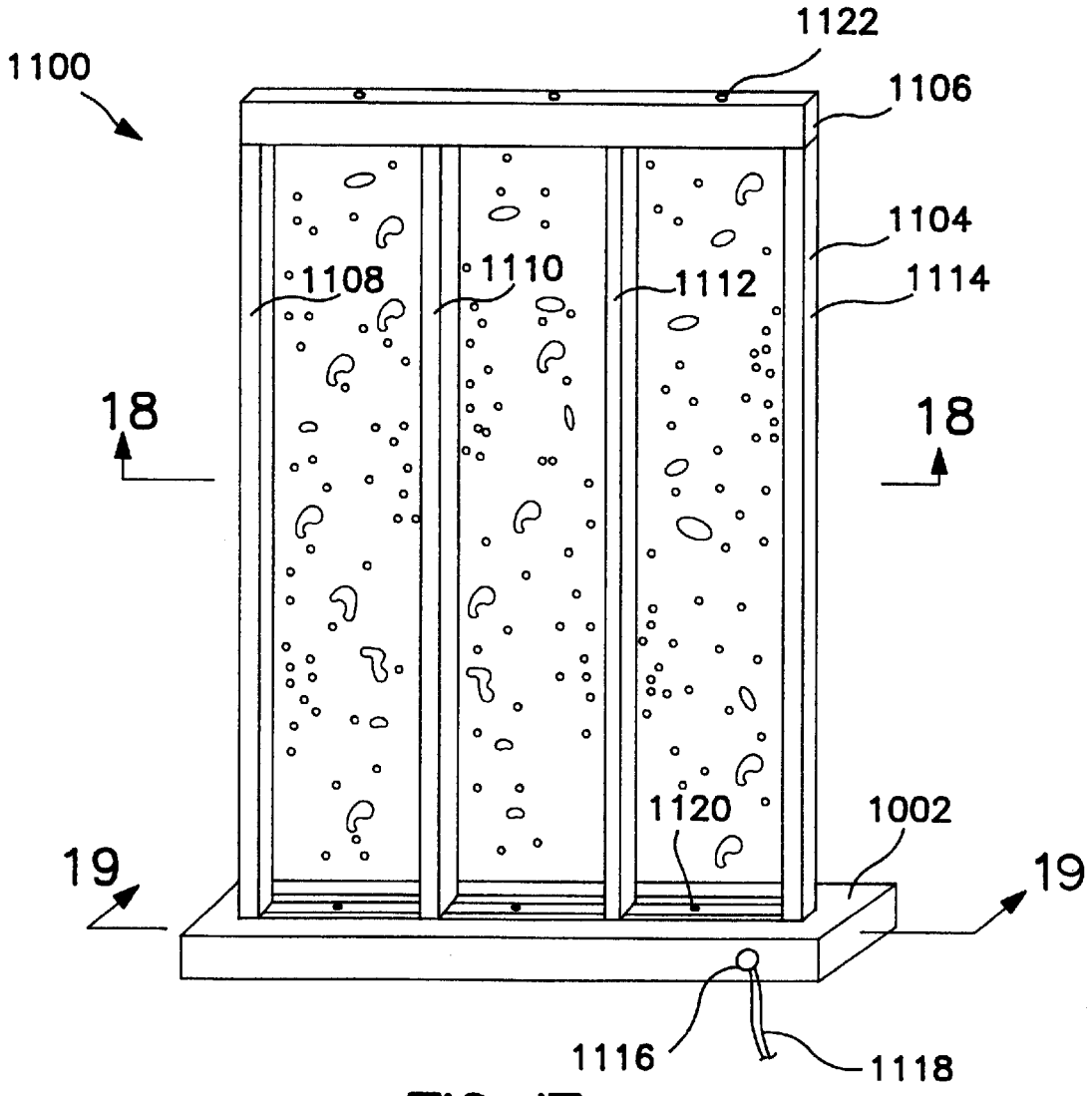
FIGS. 17 through 20 are views of a leak-proof embodiment of the Bubbling Liquid Display of the present invention.

Referring briefly ahead to FIG. 17, a detail view of the mounting of panel 202 to base 204, including placement of spacers 244, the creation of gap 246, and the placement of lamps 264, is shown. Bottom plate 214 is attached to upper shelf 240 of base 204 using bolts 245. Placement of bolts 245 is such that spacers 244 are positioned on the outer edges of bottom plate 214 and held in place by bolts 245. Importantly, gap 246 extends the entire width of the panel such that there is no portion of the front sheet 208, back sheet 210, left side 211 or right side 212 which are not directly above the gap 246.

A colorizing sheet 247 may be inserted into gap 246 to provide colorization to any illumination generated by lamps 264. For a unique colorization effect, colorizing sheet 247 may actually consist a number of smaller colorizing sheets, each having its own color. Moreover, by placement of smaller colorizing sheets 247*a*, 247*b*, 247*c*, 247*d* in gap 246, each chamber 222, 224, 226 and 228 can be colored separately. In fact, because the height of gap 246 is typically greater than the thickness of a colorizing sheet, multiple colorizing sheets can be combined, or stacked together, to make a different color (e.g. a blue sheet and a yellow sheet combined to make a green colorization effect).

Positioning of one lamp 264 beneath each chamber 222, 224, 226, 228 allows for the selective and variable illumination of each chamber individually. This selective illumination, in combination with the ability to individually color each chamber, provides for unlimited possibilities of color and light, yielding a unique visual effect which is both aesthetically pleasing, and simple to create and modify.

Referring back to FIG. 3, pumps 248 are in fluid communication with chambers 222, 224, 226, 228 such that air pressurized by the pumps is introduced, via air inlets 234, into the chambers. Referring specifically to first chamber 222, as air is introduced into the chambers, both big bubbles 282 and small bubbles 284 are formed. Unfortunately, it is difficult to pictorially show the truly unique and dynamic behavior of these bubbles 282 and 284, however, such behavior will be described in detail, and illustrated in FIGS. 1, 2, 3, 10, 11, 12, 13, 14, 15, and 16. However, it should be appreciated that the true behavior of the bubbles may range from a simple upwards glide, to a violent and turbulent swirling motion, creating unusual currents and resulting in extraordinary bubble patterns, and that the bubble patterns illustrated and described herein are merely exemplary of those patterns and effects contemplated as the present invention.

As will be shown by comparison to chambers 224, 226 and 228, by varying the air pressure to each chamber, a variety of bubble patterns may be created. For example, in first chamber 222, as big bubbles 282 are formed, they begin to rise upwards in direction 287, creating dynamic circular currents 288 within chamber 222. In addition to the big bubbles 282, a number of smaller bubbles 284 are also formed. However, in contrast to the big bubbles 282, the small bubbles 284 are forced downwards in direction 290 by circular currents 288. The circular currents will be instantly created in a specific location in the chamber, and will just as instantly disappear, providing a random quality in the movement of the air bubbles 282 and 284. The appearance of big bubbles 282 flowing upwards, combined with the smaller bubbles 284 flowing downwards is an extraordinary visual effect for this art, providing the present invention with a significant advantage over any prior art units.

In addition to creating the circular currents 288 in chamber 222, the big bubbles 282 follow a quasi-sinusoidal pathway 286, or curve, in their movement upwards. This formation of the sinusoidal pathway 286 is as dynamic and unstable as the formation of the circular currents 288. In other words, at one instant, the pathway 286 may be a gradual sinusoid having an amplitude of several inches and a period equal to or less than the height of the panel, and an another instant, may be a violent sinusoid having an amplitude as large as the width of the chamber and a period of only a fraction of the height of the panel.

Referring now to second chamber 224, the pump 248 supplying this chamber is regulated, either by gang valve 252 or volume adjustment 280, to provide a lower volume of air, resulting in the formation of medium bubbles 292 and smaller bubbles 294. However, despite the smaller size of bubbles 292 when compared to big bubbles 282 of first chamber 222, currents 296 are formed by bubbles 292 moving upwards, thereby forcing smaller bubbles 294 downwards in direction 298. Like the bubbles 282, 284 in first chamber 222, bubbles 292 follow a sinusoidal pathway upwards in chamber 224. Again, despite the lower air volume, this visual effect is astounding and provides a unique aesthetic appeal above any prior art units.

Third chamber 226 is provided with an air supply having considerably less pressure than either chambers 222 or 224, resulting in the formation of small bubbles 300 which simply rise upwards in direction 302. These bubbles 300 are sufficiently small that they create no circular currents as shown in the previously described chambers.

Fourth chamber 228 is provided with an air supply which is greater than that of first chamber 222, resulting in the formation of extra-large bubbles 306 and small bubbles 308. Similar to chambers 222 and 224, the extra large bubbles 306 move violently upwards in direction 310, thereby creating swift circular currents 312 which force small bubbles 308 in downwards in direction 314. While difficult to depict pictorially, it should be appreciated that, given the strength of the circular currents within these chambers, it is possible for a small bubble present at the upper surface 320 of the fluid 232 in a chamber to be forced all the way down to the bottom of the chamber. This results in a phenomenal visual effect of larger bubbles moving upwards, and smaller bubbles moving downwards. Such counter-intuitive motion is quite aesthetically pleasing, generally fun to watch, and results in preference of the present invention over any units in the prior art.

In order to provide the appropriate environment for the formation of the above-described currents and motions, it is important that the chambers be created to have a particular width. While the exact width of the chambers is not critical, it is advantageous to have a chamber width 229 in the range of approximately 3 inches to 7 inches, with the width of each chamber preferably being in the range of about 5 inches to 6 inches. Thus, placement of ribs 220 is important in order to create a panel 202 which exhibits the visual effects described herein.

The thickness of the chamber is also important to the proper formation of the larger bubbles, circular currents, and sinusoidal pathways. In general, like the width of the chambers, dimensions are not critical. However, it has been found that a chamber thickness in the range of approximately ⅜ inch to 1 inch will yield the desired visual effects, with the thickness preferably being about ⅝ inches.

In addition to the need for a properly sized chamber, it is also necessary to have a sufficiently powerful air pump 248 to create the over-sized bubbles described herein. The air pumps selected for use in the present embodiment are model BP 101-1 manufactured by Binaca Products, and capable of producing air at a pressure of 7 psi, and a volume of 4500 cc per minute. When considering the alternative self-contained air pumps which are on the market, the Binaca pump is unusually powerful, and consequently well-suited for the incorporation into the present invention. In fact, the use of a smaller, lower pressure air pump will not have the ability to form the larger bubbles, particularly when the air inlet is positioned at the bottom of the taller displays where water pressure can be a significant force to overcome. Moreover, any pump which can not provide the high volume of air is likewise unsuitable for use in the present invention as it will be unable to form the larger bubbles necessary to create the unique visual effect.

The diameter of the air inlet also contributes to the proper formation of the bubbles discussed herein. In Display 200, it has been discovered that an air inlet having a diameter in the range from about 1/16 inch to ¼ inch is adequate to provide the air flow necessary to form the larger bubbles. It should be noted that the diameter of the air inlet shown in FIG. 3 is preferably about ⅛ inch (or 0.125 inch). An air inlet having a diameter of ⅛ inch has been found to be well suited for the formation of larger bubbles, as a diameter of less than ⅛ inch yields bubbles of a smaller size, and creates an unnecessary restriction on the flow of air into the chamber. On the other hand, an air inlet diameter much larger than ⅛ inch manifests little improvement in the formation of the bubbles, yet provides for a potentially larger and faster-flowing leak if there is a failure in the gang valve 252 or check valve (not shown in this Figure).

With a chamber sized approximately 5 inches in width and ⅝ inches in thickness, and the panel being about 6 feet in height, the volume of fluid necessary to fill the chamber is about a gallon. Consequently, there can be a significant water pressure exerted on the lower portion of the panel, and may cause the reverse flow of water through tube 254, gang valve 252, and tube 250. To prevent the reverse flow of the fluid through the tubes and valve, a check valve (not shown in this Figure) may be inserted in line with either tube to prevent any fluid from flowing downward into pumps 248.

Fluid 232 of the present invention may include a variety of solutions. Most commonly, Display 200 is filled with a water solution which is extremely cost effective and will adequately form the bubble patterns discussed herein. The use of water, however, even the distilled variations, often allows contamination of the panel due to the constant passage of air through the chambers, resulting in the formation of mold and algae on the inside surfaces of panel 202. In an effort to combat this, a quantity of chlorine may be added to the water to form a mildly acidic solution which will delay such contamination. However, the concentration of chlorine will decay over time, and is further diminished when the panel 202 is exposed to sunlight. Additionally, the continued presence of chlorine in the fluid 232 tends to bleach the surface of the acrylic.

Alternatively, Display 200 may be filled with a fluid from the class of polymeric alcohols, such as polypropylene glycol and/or polyethlylene glycol. Fluid 232 may contain a combination of these polymers, which may be mixed with water to form solutions having various concentrations. The presence of either polypropylene glycol or polyethlylene glycol serves to reduce the formation of any contamination on the inside surface of the panels. In fact, in solutions of 100 percent polymeric fluid, no evaporation is experienced and no contamination will form despite the passage of air bubbles through the fluid for a period of years. This is a significant advantage in the maintenance of Display 200 when considering that a panel filled with a chlorine treated water solution will need to be drained, cleaned, and refilled at least twice a year, and more likely nearly every month.

A drawback exists, however, in the use of a purely polymeric solution as fluid 232. This drawback includes the formation of microscopic cracks on the surface of the acrylic, commonly referred to as "crazing," following extended exposure of acrylic to the polymer. Such crazing, however, is minimized when the polymeric solution is diluted with water. Specifically, the dilution of the polymeric solution to less than about 50% polypropylene glycol greatly decreases the crazing of the acrylic. In a preferred embodiment, Display 200 is filled with a fluid comprising a mixture of water and polypropylene glycol. Preferably, the solution includes about 50% water and about 50% polypropylene glycol, thereby combining the affordability of water with the maintenance-minimizing characteristics of the polymeric solution. It should be noted, however, that the actual percentages of each solution are not critical so long as there is a combination of water and polymeric fluid in the fluid 232.

Alternatively, instead of the non-toxic polypropylene glycol, a mixture containing polyethelyne glycol is miscible in water and would provide similar benefits in use in Display 200. Polyethelyne glycol, however, is slightly toxic and will create an environmental nuisance when attempting to drain and dispose of the fluid 232 in panel 202.

As another alternative to the use of the polymers discussed above, it is possible to use a silicone-based fluid, such as those manufactured by Dow Corning. Specifically, dimethly siloxane, marketed under the model number DC 200, may be used in Display 200 to provide many of the benefits discussed above, including the minimization of maintenance. The DC 200 fluid can range in viscosities from 0.65 to 2,500,000 centistokes, has a low vapor pressure, and a relatively constant viscosity despite changing temperature. Consequently the DC 200 fluid may be used in a variety of environmental situations, ranging from direct exposure to sunlight, to exposure to sub-freezing temperatures, without the danger of freezing or change of viscosity. Other fluids available from Dow Corning may also be well suited for use in Display 200, and include DC 510 (phenylmethyl polysiloxane), FS-1265 (fluorosilicone), to name a few. It should be appreciated, however, that a wide variety of solutions may be used in Display 200, so long as the solutions are inert to acrylic, and provide the benefits of decreasing any required maintenance.

Fluid 232 may also include a mixture of trichloroethane and trifluorotrichloroethane. Generally, any fluid containing a mixture of these fluid would be suitable for Display 200, but a ratio of about 50% of each is preferred, and results in the minimization of maintenance discussed above.

Display 200 is equipped with a number of filling and exhaust ports 230 positioned on the top 219 of panel 202. In a preferred embodiment, these exhaust ports 230 include a threaded tapered stud, or pin-valve, which threads into a threaded portion of top 219. Thus, by threading the stud into threaded portion in top 219, the chambers are sealed. Conversely, by un-threading the stud from the top 219, air is allowed to escape. Moreover, by removing the stud from top 219, a fluid filler tube or funnel (not shown) may be inserted into the chambers in panel 202 to facilitate filling the panel.

Importantly, ports 230 enable the sealing of chambers 222, 224, 226, 228 by threading the studs into the top 219. Once sealed, it is possible to disengage the panel 202 from base 204 without fear of fluid spillage from the panel. Also, by only partially un-threading the studs from ports 230, a quantity of air is able to escape from chambers 222, 224, 226 and 228, while impeding the flow of any fluid through ports 230. For example, in a typical usage, the studs are removed from ports 230 in top 219 and the chambers in panel 202 and the chambers are filled with fluid 232. Once filled, the studs are re-inserted into ports 230 and threaded partially into top 219, leaving ports 230 sufficiently open to allow the escape of air from the chambers. However, in the event the panel is partially tilted, or knocked completely on its side, the presence of the studs partially threaded into ports 230 will prevent any significant leakage of fluid from panel 202. In fact, once a small volume of fluid escapes through ports 230, a partial vacuum is created in chambers 222, 224, 226, 228 thereby preventing any further leakage.

In addition to the safety benefits of having ports 230, the ability to seal the panel 202 allows for the simple movement of the Display 200. For example, by closing ports 230, e.g. threading the studs completely into top 219, the panel 202 may be removed from base 204 and positioned on its horizontally on its side or flat, and will not leak any fluid. This allows for the movement of the Display 200 without the need for draining and refilling.

As an alternative to ports 230, an anti-siphon valve (not shown) may be substituted which would provide the free ventilation of air from panel 202 and chamber 222, 224, 226, 228, but would prevent the flow of fluid through the valve. As anti-siphon valves are well known in the art, the details of such a valve are not described herein, however, it is to be appreciated that the use of any valve which would allow the escape of air, yet resist the flow of fluid, is contemplated.

Once the base 204 is positioned, panel 202 is mounted and filled with fluid, a cap 206 is positioned over top 219 of panel 202. This cap may have a variety of shapes, but in a preferred embodiment is formed as a hollow sleeve sized to slide over the upper end of the panel 202 in direction 340. In addition to providing an aesthetically pleasing cover for ports 230 and top 219, the cap 206 may be equipped with a mirror (not shown). This mirror is sized to be inserted inside cap 206 and positioned to reflect any illumination exiting from top 219 back into panel 202. Such a mirror enhances the illumination of the upper end of the panel 202, as the upper end may experience a decrease in light from the illumination sources in base 202 due, for example, to the interference caused by the bubbles.

In an alternative embodiment of Display 200, ribs 220 may not be sufficiently long to create individual sealed chambers, but may instead be sized to extend substantially the length of the panel 202, yet leaving a small gap (not shown) between the lower end of the rib 220 and the bottom plate 214. This small gap creates a fluid passageway and allows fluid to flow gradually between the chambers 222, 224, 226, and 228, thereby allowing the fluid height of each chamber to equalize. While this fluid passageway through the small gaps at the end of the ribs will serve to eliminate the any uneven fluid levels in chambers 222, 224, 226, 228 within the panel 202, the many maintenance and safety benefits of having distinct chambers are lost. Alternatively, it is possible to provide a fluid passageway between chambers 222 and 224, and 226 and 228, yet maintain isolation between chambers 224 and 226 thereby combining some of the benefits of having a balanced fluid level with a higher degree of safety.

Figure 4:
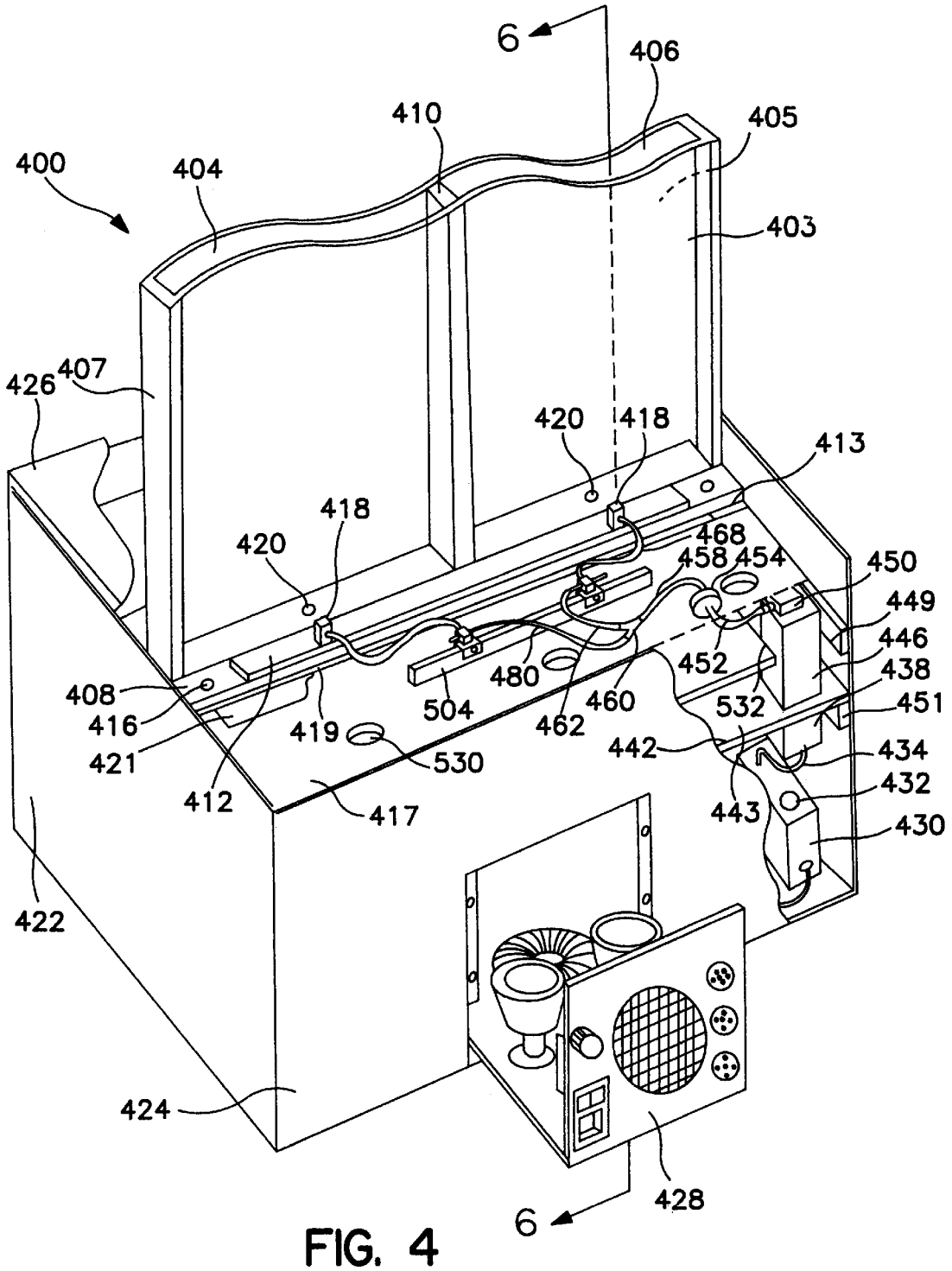
FIG. 4 is a partial perspective view of an alternative embodiment of a Bubbling Liquid Display with portions of the base and base lid removed for clarity, showing details of the mounting of the panel to the base, the color-adding material, removable drawer, overflow basin, and air supplying circuitry.

Referring now to FIG. 4, an alternative embodiment of the Bubbling Liquid Display of the present invention is shown with portions cut away for clarity, and generally designated 400. Display 400 includes a panel 402 having a front 403, a back 405 and sides 407 which combine with bottom plate 408 and rib 410 to form a first chamber 404 and a second chamber 406. Attached to bottom plate 408 is a manifold 412 which is attached to air inlets 418 in fluid communication with injectors 420 positioned within chambers 404 and 406.

Panel 402 is attached to upper shelf 417 of base 422 using bolts 416 which pass through bottom plate 408, spacer 413, and upper shelf 417. These bolts 416 also serve to retain the spacer in position against the outer wall 424 of base 422, thus forming gap 419. Colorizing sheet 421 is slidable into gap 419 to provide colorization of any illumination passing upwards from base 422 to panel 402.

Figure 5:
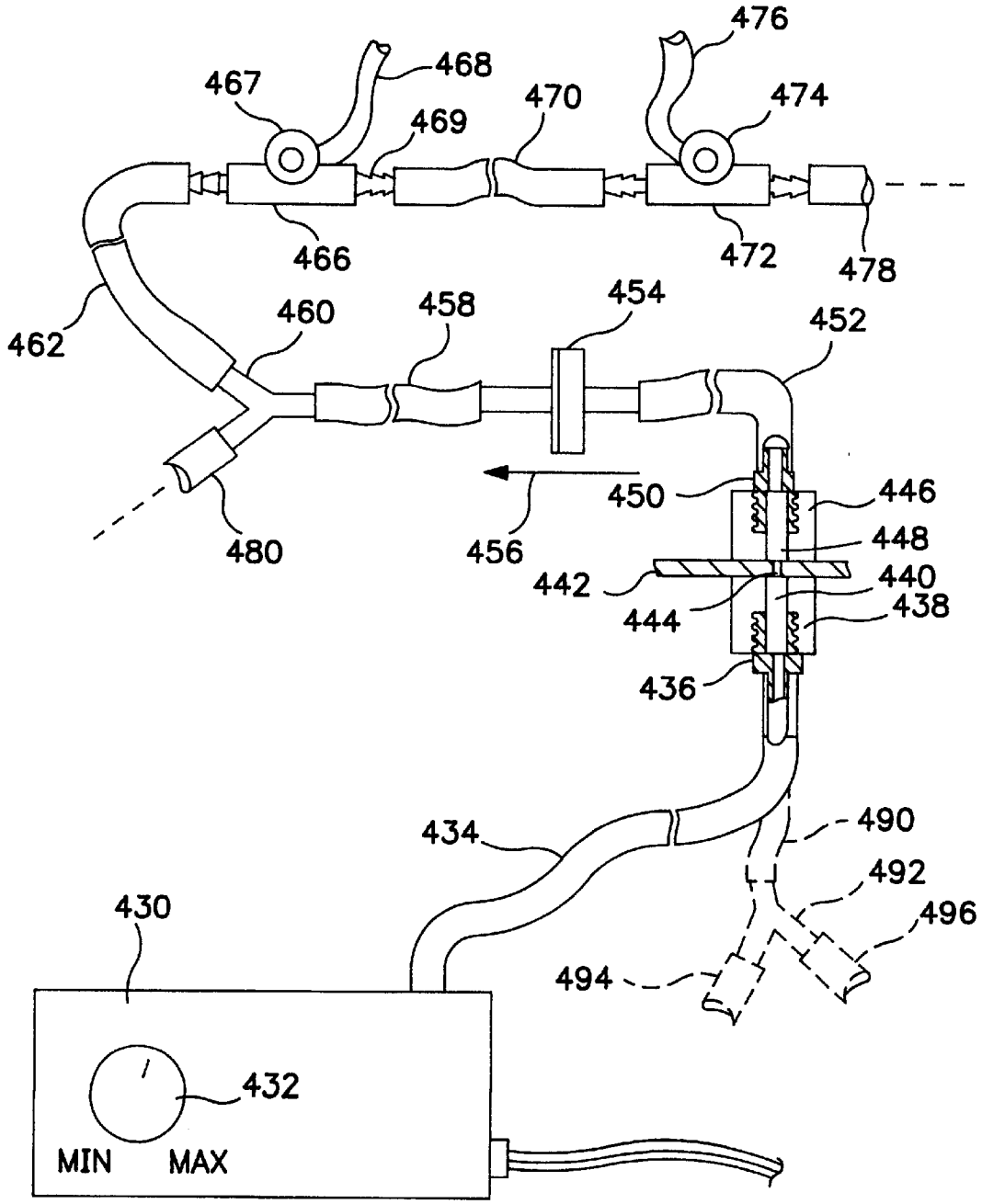
FIG. 5 is a diagram of the air-supplying mechanism of a Bubbling Liquid Display, showing the pump, overflow basin connections, check valves, and adjustable air control valves which provide air to the individual chambers.

Referring now to FIG. 5, the air supply system of Display 400 is shown and includes a pump 430 which creates pressurized air to flow from pump 430 through tube 434. Tube 434 is attached to lower nipple 436 of lower block 438 which is securely attached to lower shelf 442 to create a leak-proof seal between bore 440 and hole 444 formed in lower shelf 442. Similarly, upper block 446 is attached to the upper surface of lower shelf 442 such that bore 448 is aligned with hole 444 and bore 440 to provide a leak-proof air passageway from the lower block 438, through lower shelf 442, and through upper block 446 to upper nipple 450.

Tube 452 attaches to upper nipple 450 and provides fluid communication to check valve 454 (not shown in FIG. 4) that limits the flow of fluid in direction 456, towards the water panel. The incorporation of check valve 454 is intended to prevent the flow of liquid from any chamber in the panel 402 from flowing downwards into pump 430 and base 422. In a preferred embodiment, a check valve model number 56001 available from Willager Bros., Inc. is adequate. Alternatively, a check valve model number 98553-01 from Cole-Palmer Instrument Co. may be used, however, it should be appreciated that virtually any check valve having a low forward direction resistance is acceptable.

The output side of check valve 454 is attached to tube 453 (not shown in FIG. 4) which in turn is attached to "Y" adapter 460 (also not shown in FIG. 4). Adapter 460 is included in FIG. 5 to illustrate that the air provided by a single pump may easily be split into two or more separate tubes 480 and 462, thereby supplying a number of chambers with air from the same pump. Tube 462 extends from "Y" 460 to gang valve 466 having flow adjustment knob 467 which controls the flow of air to tube 468. Additionally, pump 430 is equipped with a flow adjustment 432 which can be utilized to control the production of air by pump 430.

Figure 6:
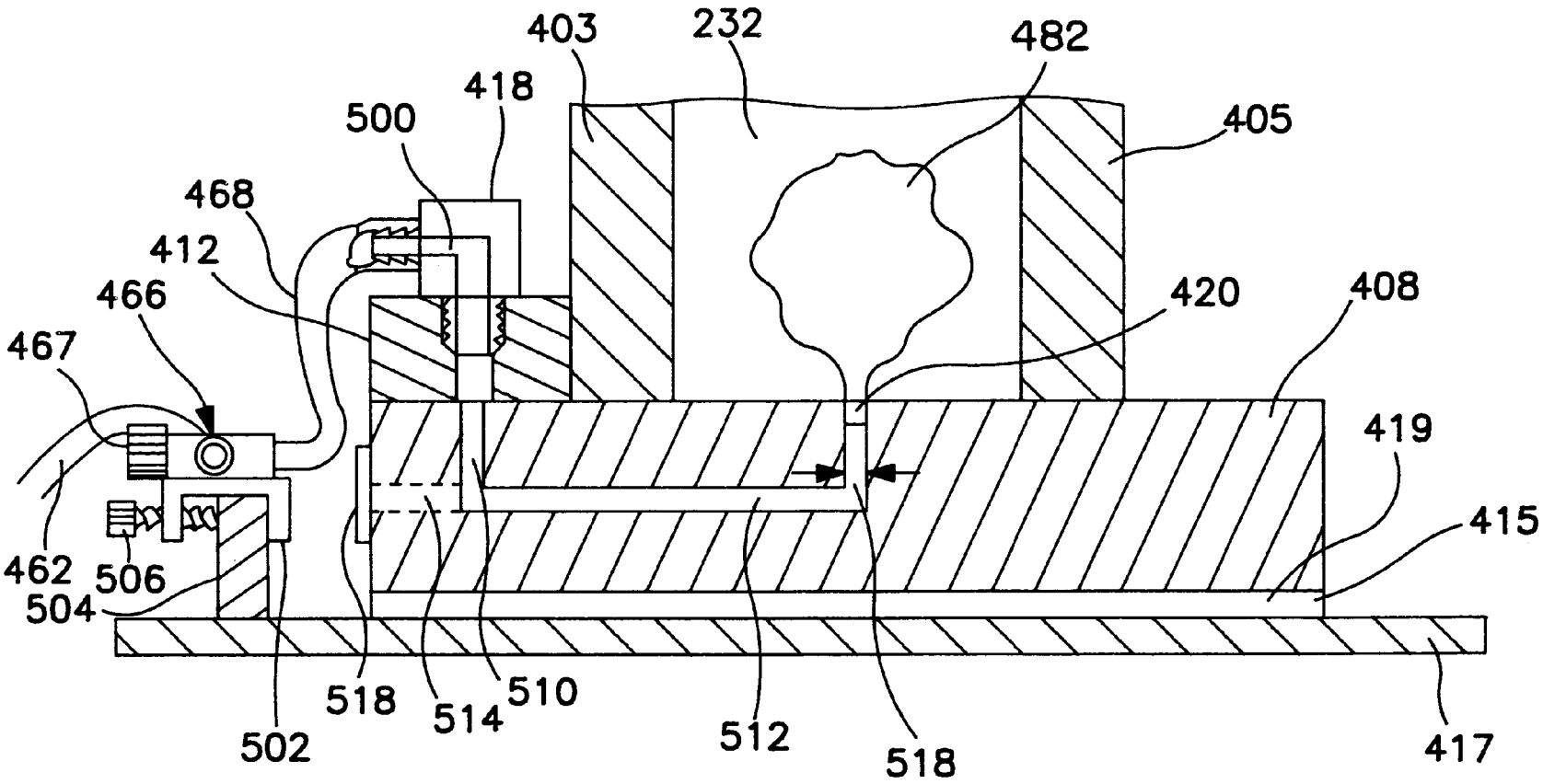
FIG. 6 is a cross-section of the air-supplying mechanism of the Bubbling Liquid Display of FIG. 5, showing the attachment of the gang valve to the air inlet, the formation of an air inlet bore from the air inlet to the chamber, and the placement of spacers beneath the panel to accommodate the color-adding material.

Referring now to FIG. 6, the communication of air from tube 468 to injector 420 of Display 400 is shown in detail. Tube 468 is attached to the input of gang valve 466 to provide pressurized air to tube 468 and to air inlet 418. By rotating flow adjustment knob 467 of gang valve 466, the pressure of air supplied to tube 468 is adjusted. Tube 468 is attached to air inlet 418 which is mounted firmly to manifold 412. As shown in cross-section, an air passageway 500 from tube 468 extends through inlet 418, through manifold 412, and into vertical bore 510 in bottom plate 408. Bottom plate 408 is formed with a horizontal bore 512 and injector 420. Horizontal bore 512 may be formed by drilling into bottom plate creating bore 514 which is subsequently sealed or covered, such as by using cover plate 518. Injector 420 is positioned in bottom plate 408 to be located approximately equidistant between front sheet 403 and back sheet 405 of panel 402. This ensures that the formation of bubbles 282 will be approximately in the middle of the chamber 406, thereby surrounded by fluid 232 on all sides.

As mentioned above in conjunction with Display 200, the diameter of the air inlet contributes to the proper formation of the bubbles and it has been discovered that an air inlet having a diameter of about ⅛ inch is preferred. Similarly, the diameter 518 of injector 420 of Display 400 should be approximately ⅛ inch to provide the bubbles most suited for this display.

Gang valve 466 is secured in place by attachment of bracket 502 to mounting rod 504 by tightening attachment screw 506. Mounting rod 504, in turn, is firmly attached to upper shelf 417 to secure gang valve 466, and any other necessary gang valves, in place. Typically, mounting rod is made of an acrylic bar, but may be made from virtually any material which would provide a rigid location to mount the gang valves.

In addition to providing a clear detail of the air supply system and injectors, FIG. 6 shows the placement of spacers 415 between bottom plate 408 and upper shelf 417. As shown, the height of gap 419 is small compared to the thickness of bottom plage 408. However, it should be appreciated that the gap 419 may be increased simply by using a thicker spacer. In a preferred embodiment, the thickness of spacers 415 is in the range of 1/16 to ¼ inch, with the thickness of spacers 415 preferably about ⅛ inch, resulting in a gap of ⅛ inch. Such a gap allows for the placement of colored acrylic sheets, or other colorized materials, often having a large relative thickness. Moreover, by providing spacers of a larger thickness, it is possible to position colorized materials having considerable thickness beneath the panel 402. Further, it would also be possible to combine the colors of various colorizers simply by stacking the colorizers together.

Referring back to FIG. 5, it should be noted that gang valve 466 is also attached to tube 470 leading to second gang valve 472 having flow adjustment know 474 controlling the flow of air into tube 476. Also, second gang valve 472 also is attached to tube 478, indicating that a number of gang valves may be linked together to supply a number of chambers with air from a single air source. It should also be appreciated that the last gang valve 476 in a series of gang valves must be capped with a sealing cap (not shown) to prevent the free flow of pressurized air out into the atmosphere. For example, if second gang valve 472 was the last valve in a series, tube 478 would be replaced with a sealing cap to prevent the free flow of air out of gang valve 472. Also, in the event that gang valve 472 was not capped, it would be possible for fluid to flow from panel 402, through tube 476, and out gang valve 472.

In addition to the ability to split a single air supply tube to supply multiple chambers, it is similarly possible to combine the outputs of more than one air pump to a single air tube. For example, tube 434 is shown in position 490 where it is attached to the output of "Y" 492. The two inputs to "Y" 492 are attached to tubes 494 and 496, which come directly from two separate air pumps (not shown). This configuration would be quite advantageous in panels 402 which require extremely large air volumes to create the desired visual effect, or in situations where the individual pumps are incapable of providing sufficient air pressure alone. In any case, it should be noted that the configuration of the air tubes, gang valves and check valves is merely exemplary, and that virtually any combination of such components is contemplated fully herein.

Referring now back to FIG. 4, base 422 is shown with portions of walls 424 removed for clarity. As shown, upper shelf 417 is shown attached to walls 424 and supported in part by support bars 449. a notch 532 is formed in the corner of upper shelf 417 which, in combination with drainage holes 530 provides for the rapid draining of any fluid leaking from panel 402 into overflow basin 443. Overflow basin 443 is created by the sealing of lower shelf 442 against walls 424 and support bars 451 thereby creating a waterproof containment within base 422. Importantly, basin 443 is sized to safely retain the entire fluid volume of panel 402 which, in combination with the sealed lower and upper blocks 438, 446, safely prevents any fluid from spilling into the lower portion of the base containing electrical components. This safety feature is significant, as it provides a fail-safe construction which virtually eliminates any danger resulting from the inadvertent mixture of electricity and water, such as electrocution, and other less painful injuries.

Base 422 is equipped with a drawer 428 which contains the majority of the components resident in the base. More specifically, Referring to FIGS. 7 and 8, drawer 428 includes a bottom 600 and a face 602. Electricity enters base 422 via an AC input module 604 mounted to face 602, and which includes an electrical cord receptacle, an on/off switch, and a circuit breaker to provide over-current protection. In a preferred embodiment, AC input module 604 is a model number PEOSOBXO available from Corcom and rated at 120 Volts at 10 Amps, however, virtually any commercial AC input model would be suitable.

Dimmer control knob 606 is also mounted to face 602, and provides for the variation of the intensity of any illumination sources within base 422. Fan 618 provides the necessary ventilation and cooling for base 422, and is directed to blow air into base 422, with the air exiting the base through air vents 620.

Bottom 600 of drawer 428 contains a low-voltage transformer, model number NWGQ2 available from PowerTronix Corp., which transforms the line voltage of 120 Volts to a low-voltage high-current 12 Volt AC voltage. This low voltage is supplied to lamps 608, 610 which are mounted to bottom 600 and oriented to direct their illumination directly upwards. This orientation provides for the illumination of first chamber 404 with lamp 608, and the illumination of second chamber 406 with lamp 610. By isolating the illumination of a chamber to a single illumination source, it is possible illuminate the chambers 404, 406 of Display 400 with lighting of varying intensities. It should be noted, however, that Display 400 incorporates only a single dimmer 606 for the control of two , but a second dimmer to provide for the separate control of each lamp could be added by one skilled in the art. Moreover, by including a dimmer for each lamp, it is possible to provide a bright illumination to chamber 404, and a lesser illumination to chamber 406, to create a unique and distinctive visual effect.

The lamps selected in a preferred embodiment are available from CEW, and have a projection angle of about 10 degrees. Thus, by carefully positioning the lamps on bottom 600 of drawer 428, one chamber is illuminated by a single lamp. However, in the event a different lamp is used which has a projection angle of greater than about 15 degrees, an opaque divider (not shown) may be provided which extends vertically upwards from bottom 600 to prevent cross-illumination between chambers.

Bottom 600 of drawer 428 is also equipped with a safety interlock switch 612, preferably model number WOYR2 available from C&K Components, Inc. Switch 612 is only in a closed position when drawer 428 is fully inserted into base 422, thereby preventing the energizing of circuitry on bottom 600 while the drawer is extended from base 422 where there would be a greater hazard of shock.

In an effort to further minimize any chances for electrical shock, terminal block 616 is provided on bottom 600 to hold other necessary electrical components while shielding the leads of the components. Terminal block 616 is preferably a model 170454 available from Weidmuller, Inc.

Figure 9:
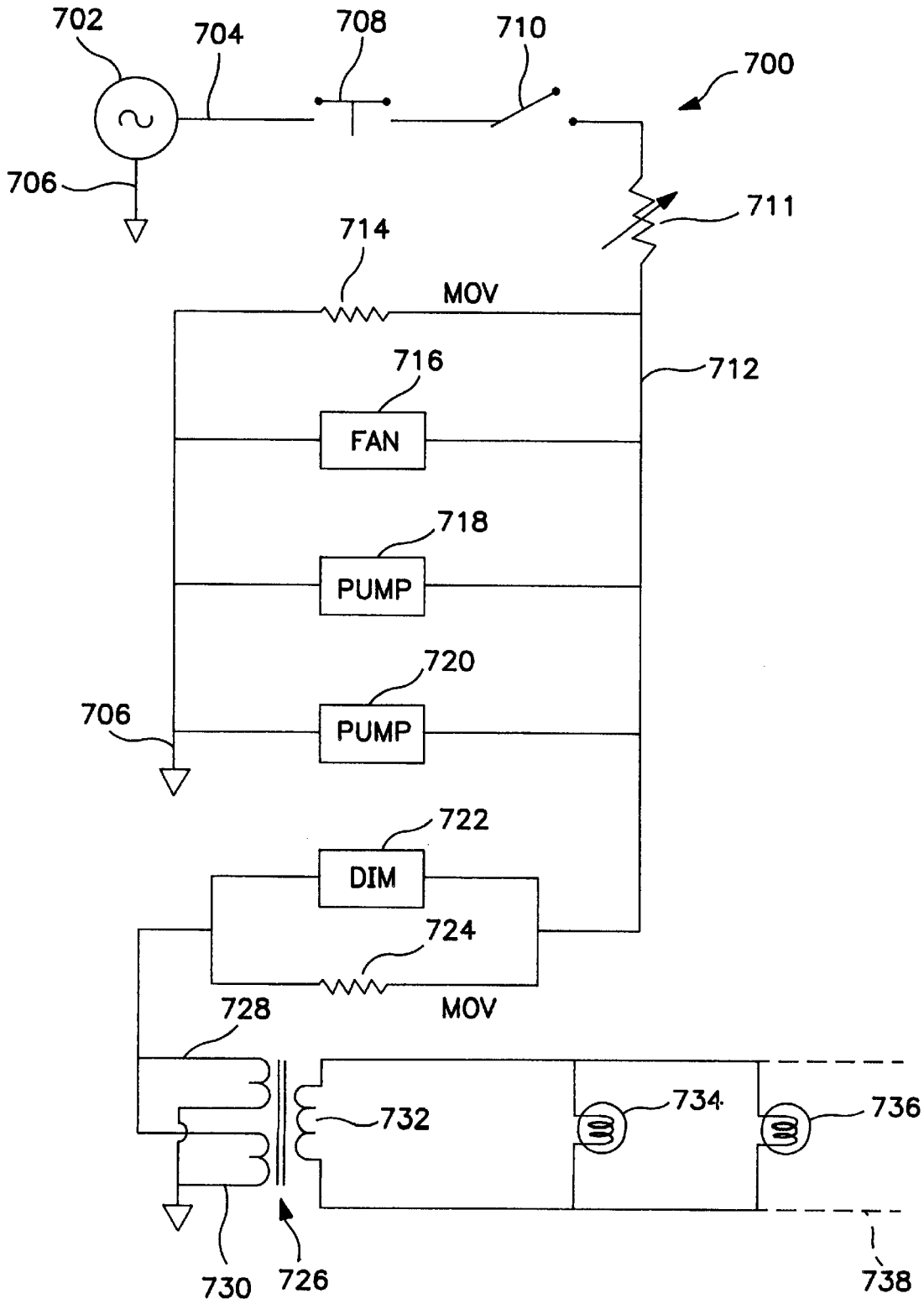
FIG. 9 is a schematic of the circuitry contained within the drawer, including the electrical connections to the AC input module, interlock switch, Fan, pumps, dimmer, transformer, and illumination sources.

Referring now to FIG. 9, a circuit diagram of the electrical components of Display 400 is shown and generally designated 700. Circuit 700 includes an AC electrical source of 120 Volts 702 having a neutral lead 706 which forms a return network (or neutral) 706, and a hot lead 704 which passes through safety interlock switch 708 to "ON/OFF" switch 710. If the drawer 428 is inserted fully into base 422, and the "ON/OFF" switch is in the "ON" position, then 120 Volts AC is supplied to a thermal switch 711 which will only pass electricity when the temperature with the base 422 is within acceptable levels. Such typical levels would be for the thermal switch to interrupt the flow of electricity when the temperature within the base exceeded  C. If the temperature is acceptable, electricity is passed to network 71 2**.

Network 712 is in electrical connection with a metal oxide varister (MOV) 714, typically of a model number V420LA40B which is rated at 420 Volts and 6500 Amps. The second lead of the MOV is attached to neutral 706 such that this MOV 714 provides a measure of over-voltage protection to Display 400 and minimizes the likelihood of damage in the event of a severe over-voltage condition exhibited by the AC Voltage source, such as between the hot and neutral.

Fan 716 and pumps 718 and 720 are electrically connected between network 712 and neutral 706 such that all three components receive a line voltage of 120 Volts. a combination of dimmer 722 and another MOV 724 are provided as input control components to one end of the primary windings 728 and 730 of a step-down transformer 726, such as the one described above from PowerTronix. The other end of the primary windings are connected to neutral 706 to provide the primary windings with an input voltage of 120 Volts. The secondary winding 732, typically at a 12 Volt AC level, but fully variable by adjusting the dimmer 722 between 0 and 12 Volts, and is provided to lamps 734 and 736. It should be appreciated, however, that more lamps could be attached to the secondary winding 732 of transformer 726, as indicated by dashed lines 738. Moreover, an addition combination of dimmer 722 and MOV 724 could be added to provide different dimming capabilities for individual lamps.

In additional to the thermal switch 711 which interrupts the flow of electricity in the event of an over-temperature condition within base 422, an alternative embodiment of the present invention includes a moisture-sensing switch which would be positioned on bottom 600 such that in the event moisture is detected in the drawer 428 in the base 422, the electricity can likewise be interrupted, thereby minimizing any possibility for an electrical shock hazard. Alternatively, the moisture-sensing switch may be mounted with the overflow basin to provide an even greater measure of protection against shock by interrupting the flow of electricity in the event of even the slightest leakage from the panel 402.

Base 422 also includes a cap 426 which, in FIG. 4, is shown with portions removed for clarity. However, it should be understood that cap 426 covers the entire upper surface of base 422, such as the Display shown in FIGS. 1 and 2. To accomplish this covering, the portions of the cap 426 immediately adjacent panel 402 are cut to conform to the curvature of the panel, if any exists. This ensures that no illumination from illumination sources within base 422 is permitted to shine upwards outside of panel 402.

Figure 10:
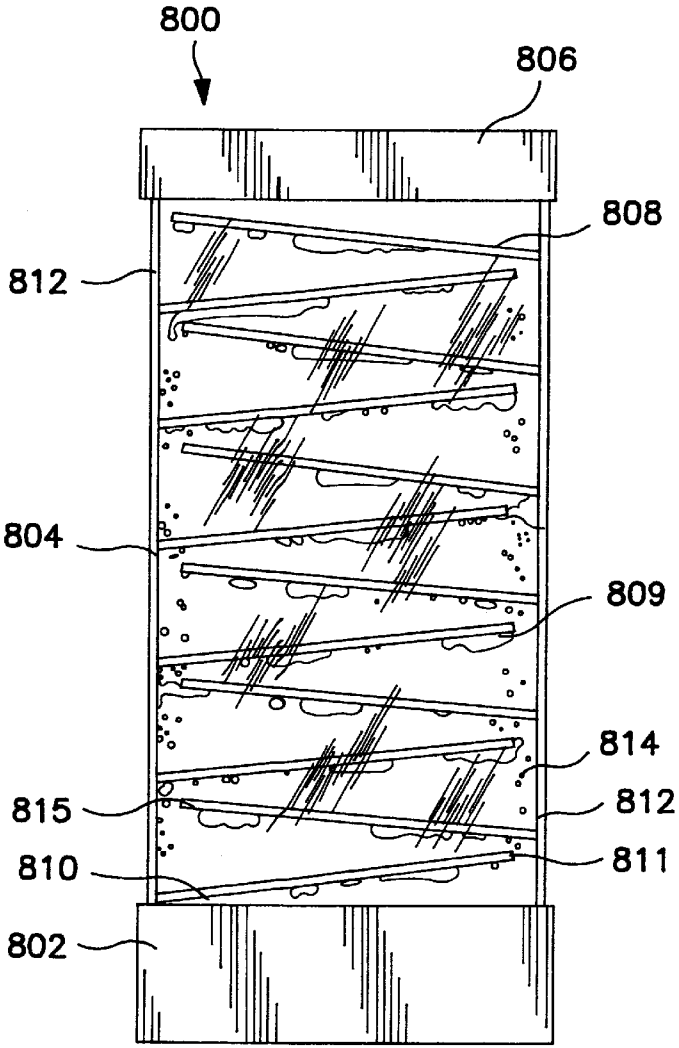
FIG. 10 is a front view of an alternative Bubbling Liquid Display showing a single chamber having ribs oriented in a substantially horizontal position within the chamber to provide a "zig-zag" pathway for the rising bubbles.

Referring now to FIG. 10, the front of an alternative Bubbling Liquid Display is shown and generally referred to as 800. Display 800 includes base 802 which supports panel 804 and topped with cap 806. Instead of having ribs which extend vertically, as in the previously discussed Displays, Display 800 includes a number of ribs 808 which are oriented in a substantially horizontal position such that the bubbles 809 trace a sort of "zig-zag" pathway as they rise to the top of the Display. Specifically, bubbles 809 are injected into panel 804 at start point 810 and move upwards along rib 811 until violently crashing into sidewall 812, creating smaller bubbles 814. Then, both bubbles 809 and smaller bubbles 814 move upwards in the opposite direction along rib 815, creating the "zig-zag" pathway. In this manner, bubbles injected at the lower end of the Display 800 move upwards. By providing a relatively low flow of the air into the panel 804, the bubbles 809 may move upwards in their "zig-zag" pathway gradually, and gracefully. However, by providing a substantially higher flow of air into the panel 804, bubbles 809 and 814 move violently upwards, creating both circular currents at the sides of the panel, and a large number of smaller bubbles 814.

Figure 11:
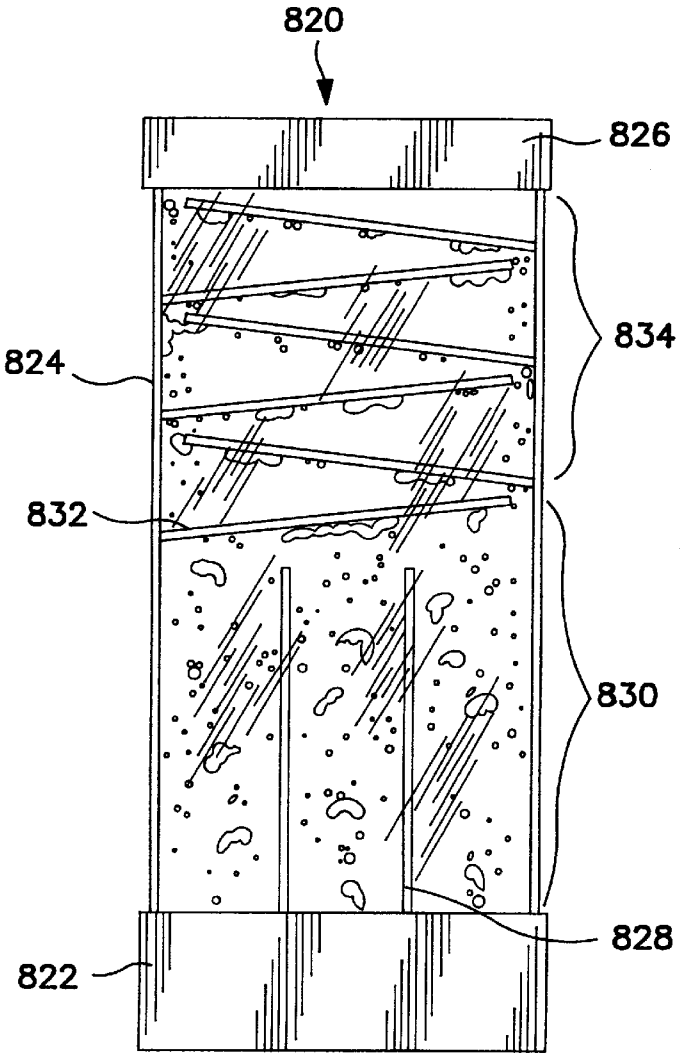
FIG. 11 is a front view of an alternative Bubbling Liquid Display showing a single chamber having a combination of vertical and substantially horizontal ribs to provide a lower section with unique bubbles in vertical chambers, and an upper section having a "zig-zag" pathway for the bubbles.

FIG. 11 shows an alternative Bubbling Liquid Display, generally identified as 820, which includes a base 822, a panel 824, an a cap 826. Panel 824 includes vertical ribs 828 in lower section 830, and substantially horizontal ribs 832 in section 834. The combination of the vertical ribs 828 and horizontal ribs 832 provides for an interesting visual effect wherein the lower section form the circular currents which create the unique circular bubble patterns, while the upper section receives those bubbles having their circular bubble patters and redirects them into a "zig-zag" pathway.

Figure 12:
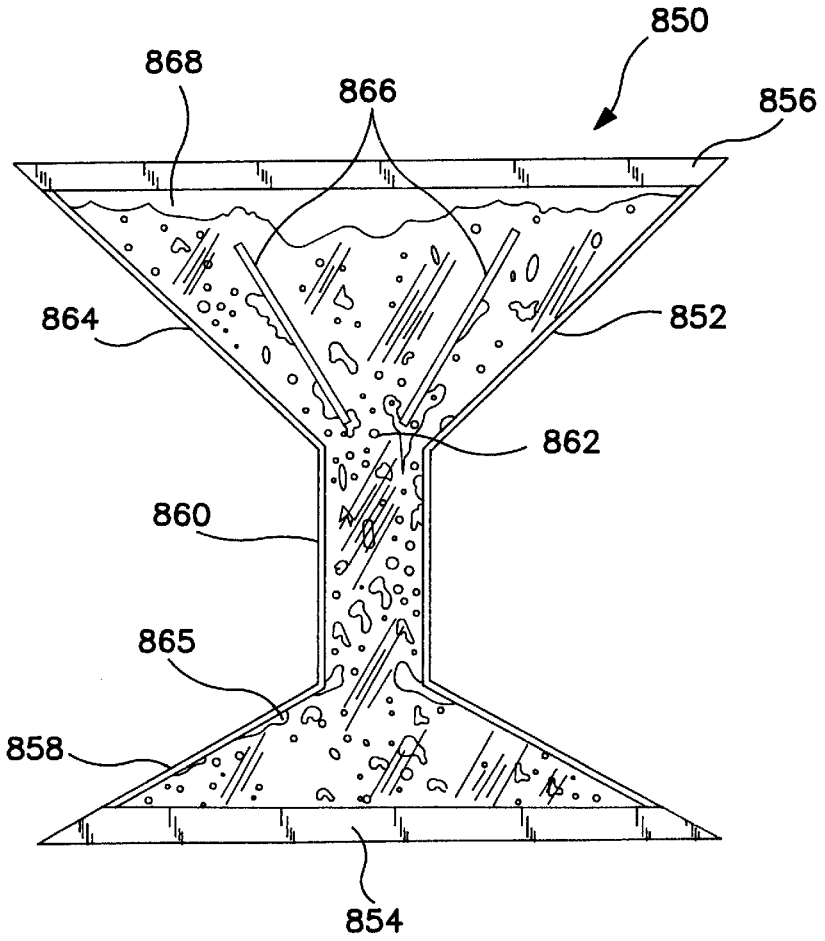
FIG. 12 is a front view of an alternative Bubbling Liquid Display shaped in the form of a champagne glass and having a pair of angled ribs in the upper portion of the display.

FIG. 12 shows the front view of an yet another alternative Bubbling Liquid Display, which is generally designated 850. Display 850 is shaped substantially like a champagne glass, having a panel 852 attached to a base 854 and covered by cap 856. Panel 852 includes a base portion 858, a stem portion 860, and a glass portion 864. Bubbles 865 originate from base 854 and flow upwards while converging towards stem portion 860, creating an increase bubble density and upwards bubble flow through stem portion 860. At the upper end of the stem portion 860, ribs 866 are positioned to angle outwards from stem portion thereby re-directing a portion of the rising bubbles upwards and outwards towards the sides of Display 850. This outward movement of bubbles creates a highly turbulent fluid surface 868 which provides an appealing visual effect, appearing much like an actual bubbling glass of champagne.

Figure 13:
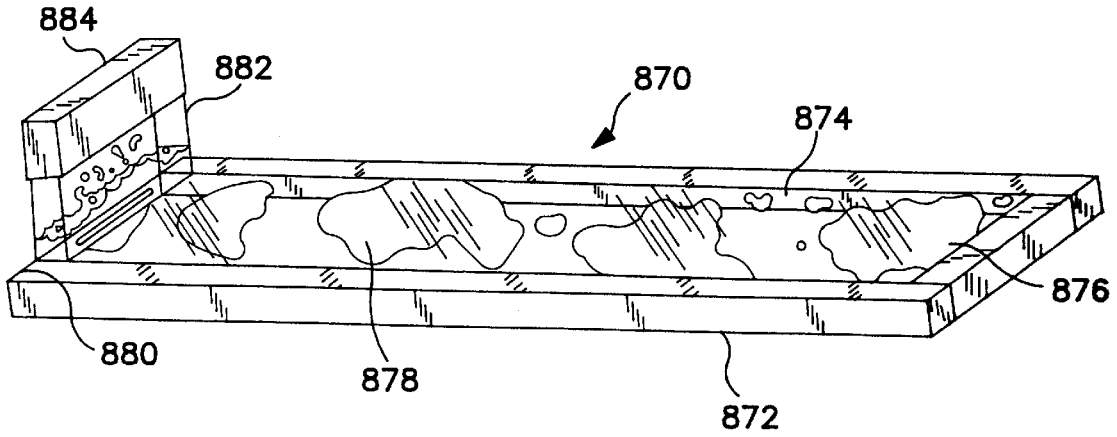
FIG. 13 is a perspective view of an alternative Bubbling Liquid Display for use as a bar counter-top, showing large bubbles gradually progressing from the origin of the bubbles at the rightmost end, to the tower portion at the leftmost end.

FIG. 13 is a perspective view of an alternative Bubbling Liquid Display, generally designated 870, which may be used, for example, as a bar counter-top. Display 870 includes a border frame 872 which surrounds a substantially horizontal panel 874. Bubbles 878 begin at end 876 and move slowly along the length of panel 874 until reaching end 880. End 880 may be equipped with a tower portion 882 which acts as a bubbling reservoir for panel 870, such that no fluid which passes from end 880 is released. Specifically, because the panel 870 is substantially horizontal, there is no point within the flat portion of the panel where the air can safely escape and the air cannot. Accordingly, tower portion 882 is provided to catch any fluid which bubbles from Display 870. To prevent the slashing of fluid from panel 870, tower portion 882 is equipped with a cap 884 which, if desired, may be easily covered or positioned within a wall adjacent the panel 870. In fact, tower portion may instead be configured as a reservoir which is located a distance from panel 874, and attached to the bubble-exiting end 880 via an overflow tube (not shown). In this manner, Display 870 may be placed in an area where a tower portion 882 would be inappropriate, such as on a dance floor, table-top, seat-top for a chair or bench, for example.

Display 870, configured as a horizontal display, may form bubbles of considerable size. For example, the bubbles, once formed within the display, slowly move away from starting end 876 towards exit end 880. Depending on the flow of air into the panel, these bubbles often start as smaller bubbles. However, as they slowly migrate along Display 870, the smaller bubbles tend to move towards, and group with, other bubbles, forming a larger and larger bubble as it proceeds towards end 880. In order to prevent the formation of larger bubbles, ribs (not shown) may be placed longitudinally within panel 870.

Figure 14:
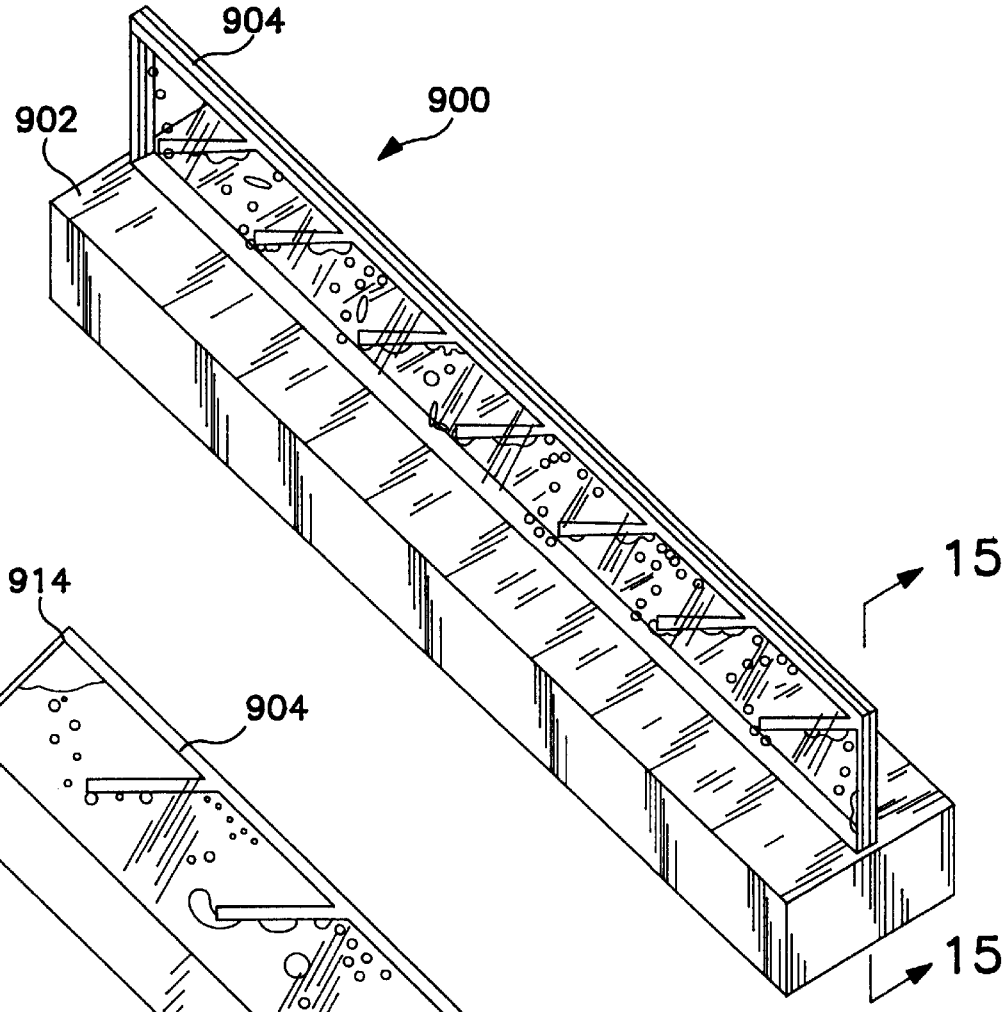
FIG. 14 is a perspective of yet another alternative Bubbling Liquid Display shown as installed on a stairway.
Figure 15:
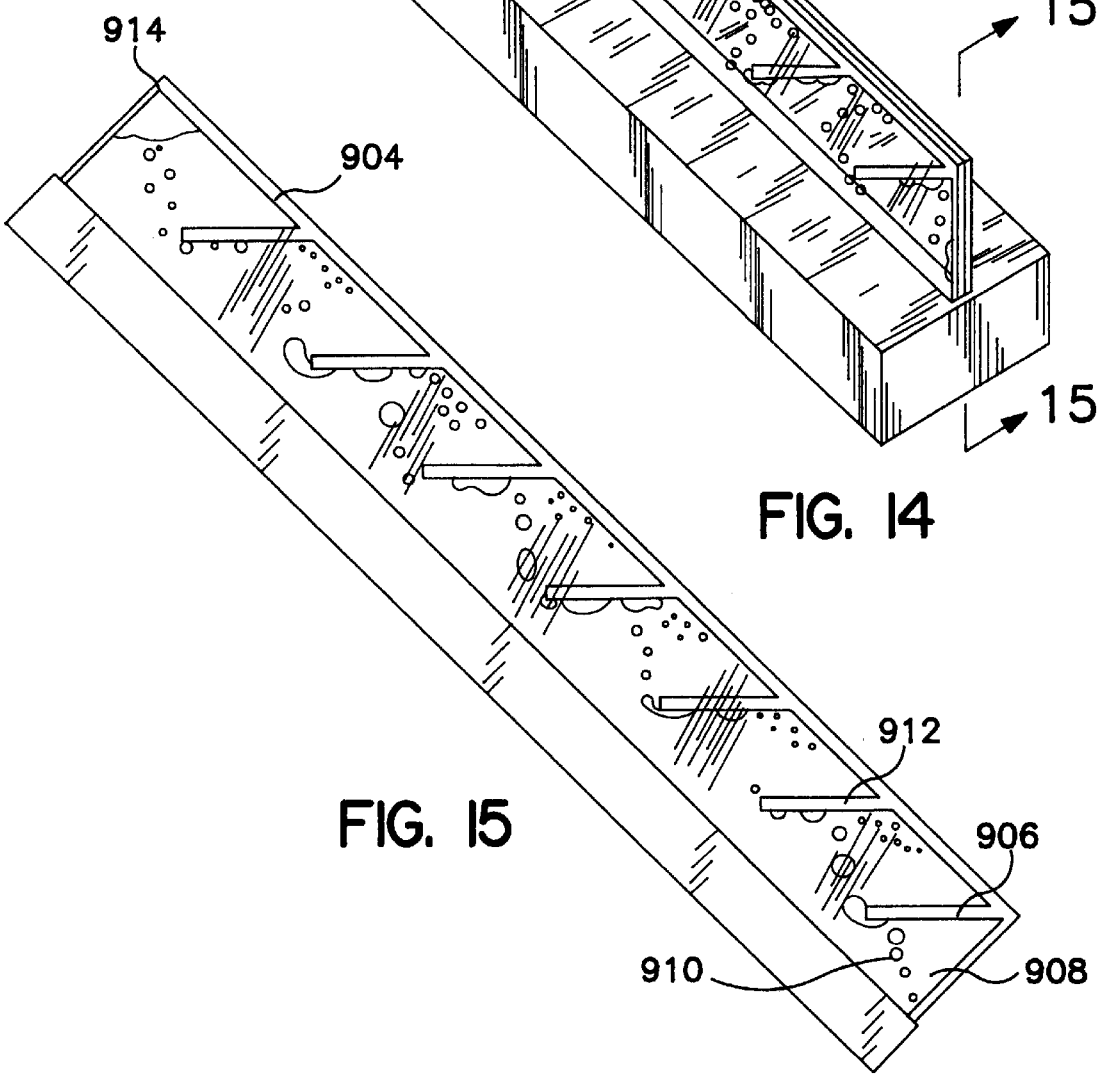
FIG. 15 is a front view of the Bubbling Liquid Display of FIG. 14, showing a number of substantially horizontal ribs extending into the display to provide a unique visual effect of bubbles ascending a staircase.

Referring now to FIG. 14, yet another alternative embodiment of a Bubbling Liquid Display is shown and generally designated 900. Display 900 is intended for installation on a stairway, or other such angled surface. Display 900 includes a base 902 and a panel 904 extending vertically therefrom. FIG. 15 shows the Bubbling Liquid Display of FIG. 14 in cross-section, detailing the positioning and function of a number of substantially horizontal ribs 906. Ribs 906 extending into the display from the upper inside surface of panel 904 such that as bubbles 910 move from start point 908 where the air is injected into panel 904, the bubbles float upwards to strike rib 906. As the bubbles collect on rib 906, they begin to move to towards the upper end of Display 900 until reaching the end of rib 906 and flowing upwards to strike rib 912. The bubbles again to collect and then continue to move towards the upper end, eventually traversing the length of the Display. Once the bubbles 910 reach the upper end of the Display, the air escapes through vent 914. Vent 914 may be concealed with a cover (not shown).

Figure 16:
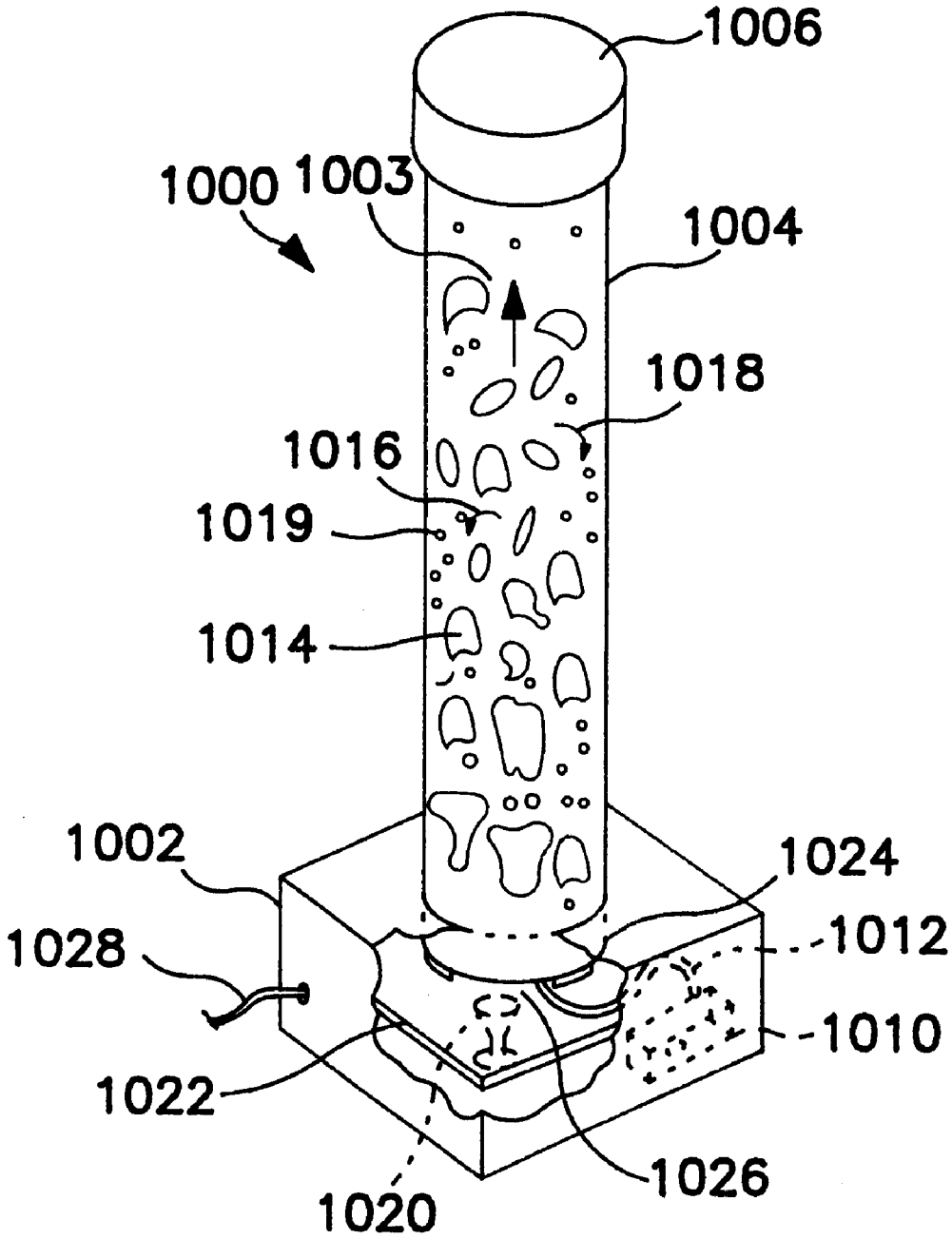
FIG. 16 is a perspective view of another alternative embodiment of the present invention configured as a vertically standing tube.

Referring now to FIG. 16, another alternative embodiment of the present invention is shown and generally designated 1000. Display 1000 is shaped as a vertically standing tube, however, it is to be understood that virtually any shaped container having a sealed lower end could be used, such as a container shaped as a soda bottle or can, for example. Display 1000 includes a base 1002 which supports container 1004 which is protected at its upper end by cap 1006. Within base 1002, pump 1010 is positioned such that tube 1012 is attachable to the lower end of the container 1004 to create large bubbles 1014. Air may be injected into container 1004 using a single injector, or it may use a number of injectors (not shown).

As large bubbles 1014 are formed, they begin to flow upwards in direction 1016, thereby creating circular currents 1018 which in turn begin creating and swirling little bubbles 1019 which, due to the circular currents, begin to flow downwards. As discussed above in conjunction with the planar panels, the flowing of the smaller bubbles in a downward direction is quite unusual, yielding an extraordinary visual effect.

Base 1002 may also be equipped with an overflow basin 1022 which serves to prevent the overflow and leakage of the container 1004, and is made of a transparent material such that illumination source 1020 can shine upwards and illuminate the contents of container 1004. Container 1024 is supported by spacers 1024 which serve to form a gap 1026 within which a colorizer (not shown) may be inserted to color the container and contents therein. Electrical cord 1028 provides all necessary electrical power to operate the pump 1010 and illumination sources 1020.

Referring now to FIG. 17, an alternative embodiment of a Bubbling Liquid Display, which is virtually leak-proof, is shown in perspective and generally designated 1100. Display 1100 includes a bottom plate 1102, a panel 1104 and a upper plate 1106. Panel 1104 is constructed with four vertical members, 1108, 1110, 1112, and 1114 which extend from the bottom plate 1102 to the upper plate 1106.

Importantly, each of these vertical members is hollow, thus providing a vertical fluid passageway from the bottom plate 1102 to the upper plate 1106 thereby forming a "U-tube" which prevents leakage of fluid from panel 1104. Specifically, pressurized air is provided to inlet 1116 through tube 1118, the air flows upwards through vertical member 1114, through upper plate 1106, and back down members 1108, 1110, and 1112, to provide pressurized air to the chambers through injectors 1120. However, in the event of the loss of pressure at inlet 1116, the fluid will only flow in a reverse direction until the fluid height in member 1112 is equal to the upper fluid surface within the chambers.

Figure 18:
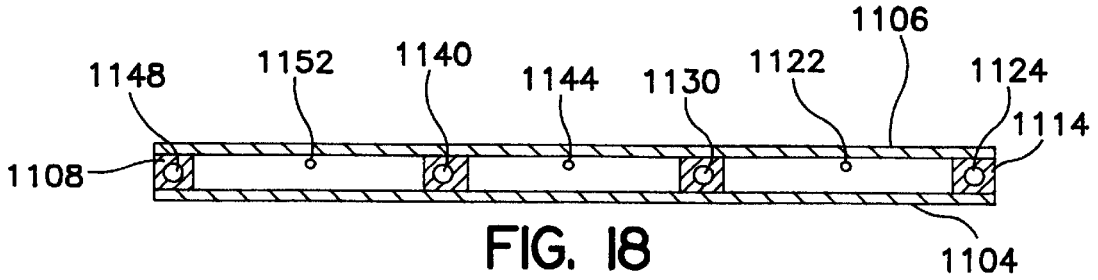
Figure 19:
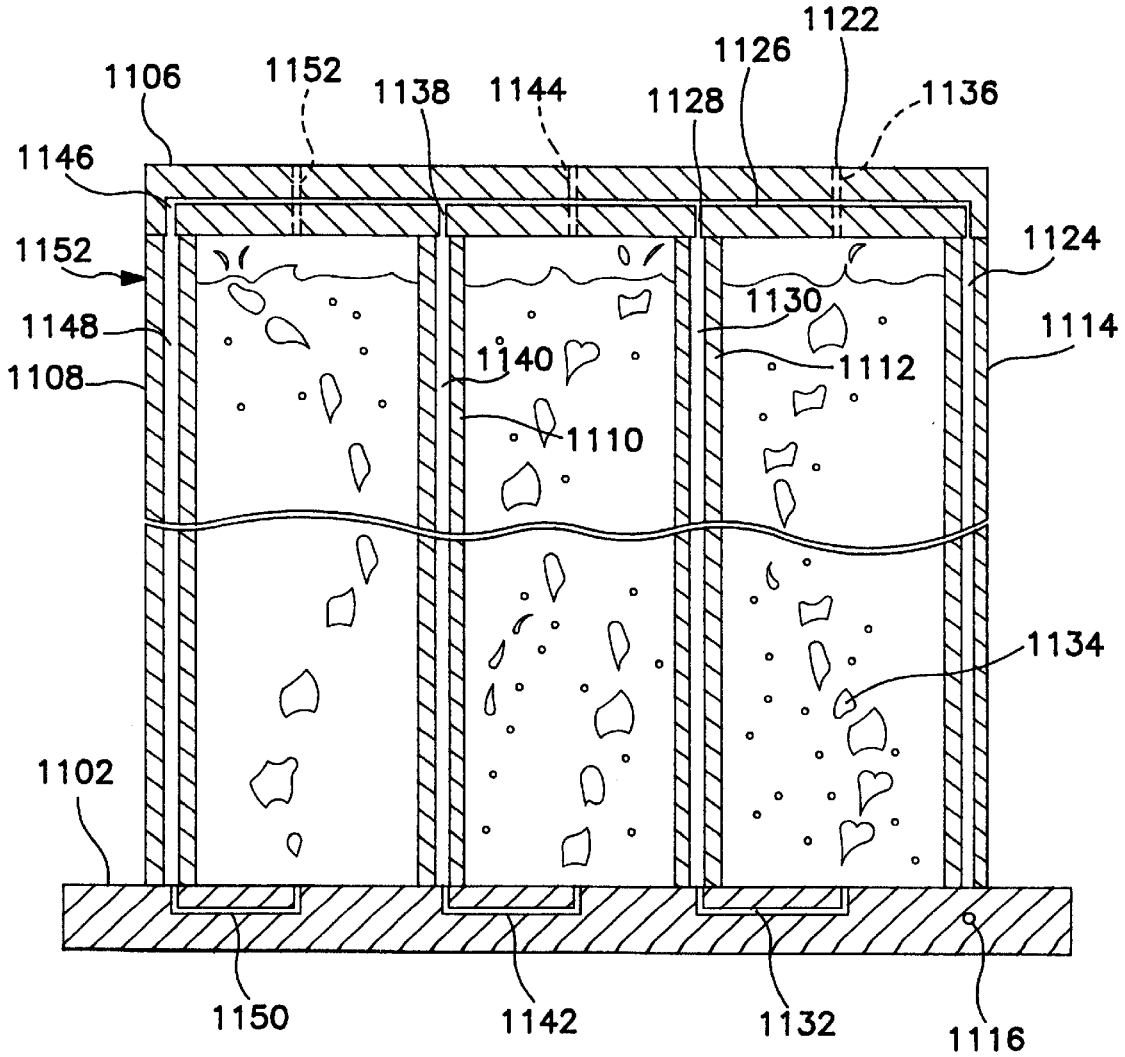

FIGS. 18 and 19 shows the Display 1100 in cross-section, more particularly detailing the construction of this leak-proof panel. Specifically, pressurized air is supplied to inlet 1116, the air passes through bottom plate 1102 to the lumen 1124 in vertical member 1114. The air flows upwards in member 1114 and is forced into airway 1126 formed in the upper plate 1106 which is in turn in communication via port 1128 with the lumen 1130 in member 1112, allowing the pressurized air to flow back down to bottom plate 1102 to injector tube 1132, and for injection into the chamber within panel 1106 to form bubbles 1134. Bubbles rise in the panel and exit exhaust port 1136 (shown in dashed lines). Similarly, airway 1126 also provides pressurized air to ports 1138 and 1146 which flows down members 1110 and 1108, to injector tubes 1150 and 1142, respectively, for injection into the chambers in panel 1104.

Figure 20:
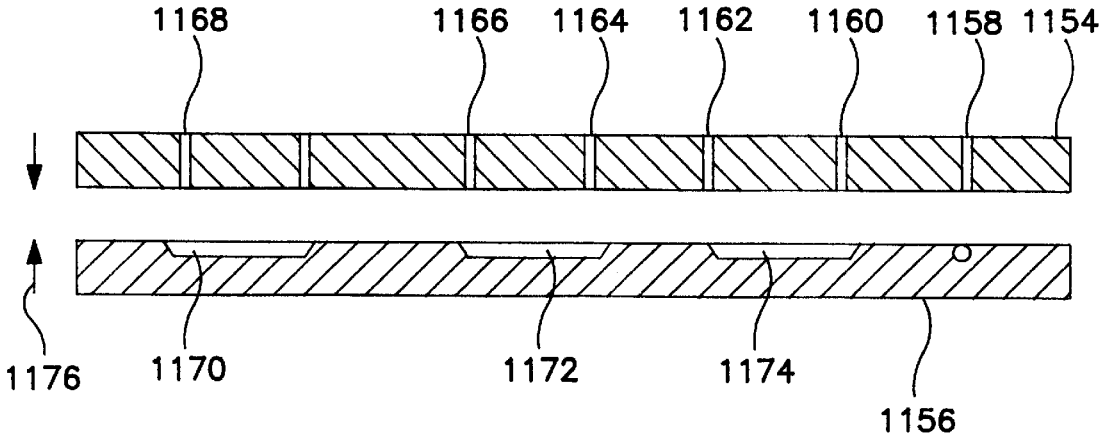

FIG. 20 is a cross-sectional view of a bottom plate 1102 which is formed from two sheets of material, such as acrylic, which are each cut to create the necessary airways when attached together. For example, bottom plate 1102 includes a upper piece 1154 and a lower piece 1156. Upper piece 1154 is formed with a series of bores 1158, 1160, 1162, 1164, 1166, 1168, which extend through the upper piece 1154, and are typically about ⅛ inch in diameter, corresponding to the optimal injector diameter discussed above. Lower piece 1156 is formed with three channels 1170, 1172, 1174 which provide for fluid communication between neighboring bores when the two pieces are joined in directions 1176. Specifically, bore 1162 will be placed in fluid communication with bore 1160 via channel 1174, thereby creating the air passageway needed to provide air to the rightmost chamber in Display 1100.

The "U-tube" formed in Display 1100 provides the leak-proof feature for the display. More specifically, in the alternative embodiment water-filled panels, the air is injected into the bottom of the chambers in the panel via a tube, a gang valve, and a check valve. The check valve prevents fluid from flowing back through the air supply tubes when the air pump fails or is turned off. These check valves, however, often become damaged, or stuck in the open position, thereby allowing the free flow of water back into the air pump, potentially causing injury to the pump, and other damage. The present embodiment of FIGS. 17 through 20, however, eliminate the need for a check valve because it is impossible for fluid to flow out of the panel unless a vacuum is attached to the supply tube. More specifically, in the event of a failure of the pump, and in the simultaneous event of a stuck check valve (if used), the fluid within each chamber will flow down into injector tubes 1150, 1142, 1132 and lumens 1148, 1140, 1130 until the height of the fluid reaches the fluid height (indicated by arrow 1152). At that point, the gravitational pull on the fluid within the chambers and the lumens equalizes, forcing the entire panel into a state of equilibrium, thereby preventing the further flow of fluid. Consequently, the "U-tube" is extremely useful in the fluid-filled display industry as it is leak-proof, allowing construction of a display without having to include check valves, or other means for preventing the flow of fluid from the panel.

Figure 21:
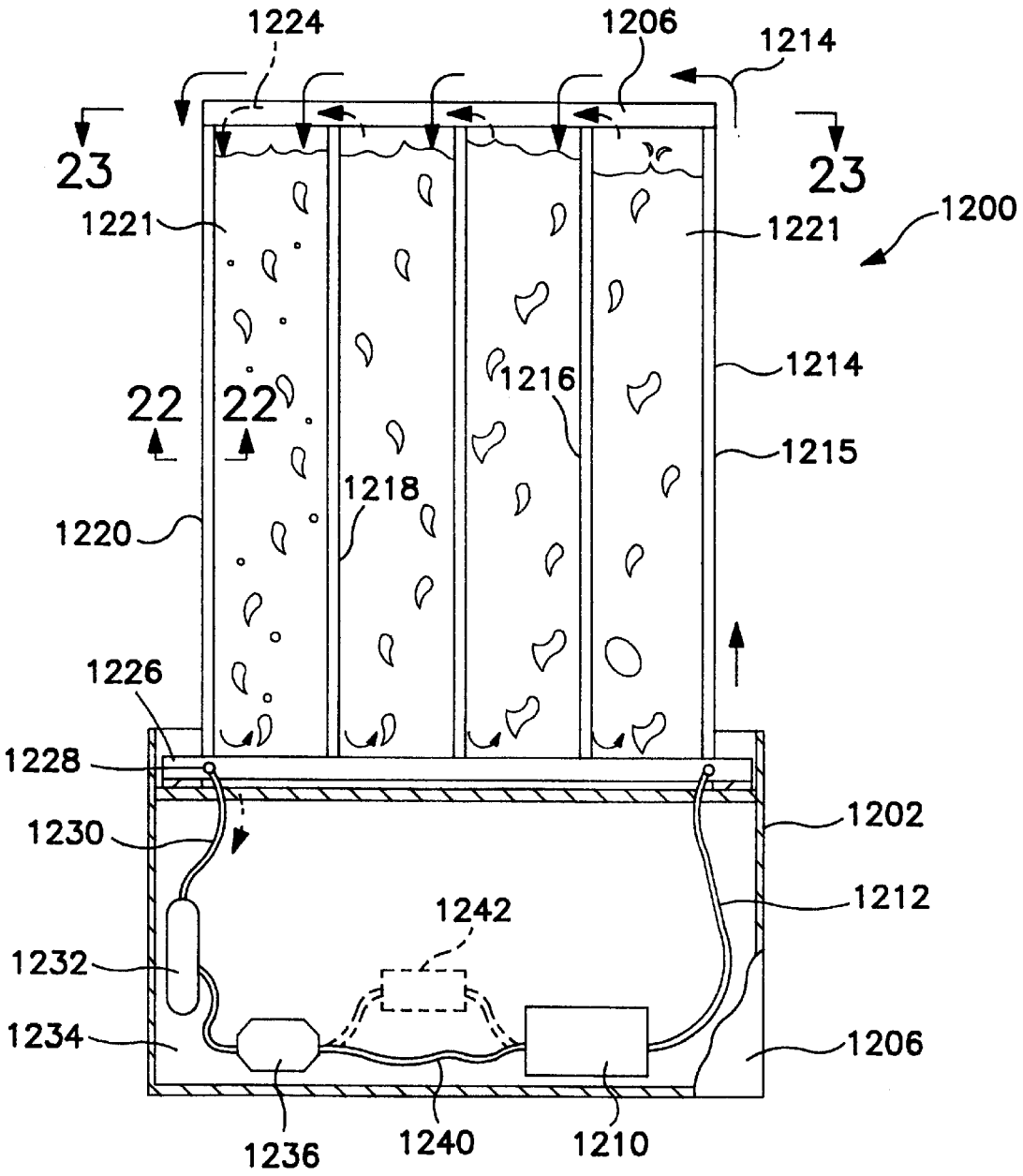
FIGS. 21 through 23 are views of a leak-proof and recirculating embodiment of the Bubbling Liquid Display of the present invention

Referring now to FIG. 21, an alternative embodiment of the Bubbling Liquid Display of the present invention is shown and generally designated 1200. Display 1200 is an entirely sealed unit, needing no air or fluid source, thereby minimizing or eliminating any evaporation and/or contamination of fluid within Display 1200. Display 1200 includes a base 1202, and a panel 1204 having an upper plate 1206 which may be covered by a cap (not shown in this Figure). Base 1202 has its front panel 1208 partially removed for clarity. Pump 1210 in base 1202 provides pressurized air into supply tube 1212 which is provided to bottom plate 1226 of panel 1204. The air is supplied to chambers 1221 in the same manner as described in conjunction with FIGS. 17 through 20, providing for a leak-proof panel 1204. In this Figure, solid direction arrows 1214 indicate a high pressure (pre-fluid) air pathway, and dashed direction arrows 1224 indicate a lower pressure (post-fluid) air pathway. Air supplied by pump 1210 flows upward through vertical member 1215 to upper plate 1206 and then directed to flow through the chambers, as described above. Once the air has passed (bubbled) through the fluid, it collects at the upper end of the panel 1204 and flows in pathways 1224 downwards through vertical member 1220. Importantly, vertical member 1220 must be a dual lumen member, as shown in FIGS. 22A and 22B.

Figure 22A:
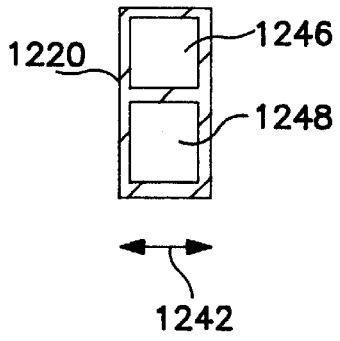
Figure 22B:
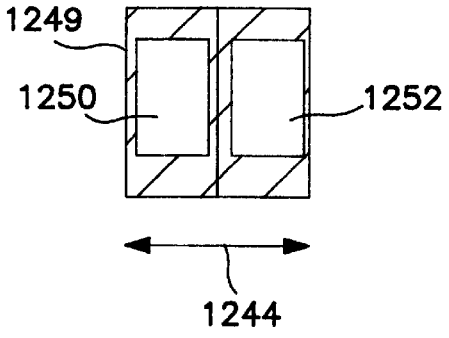

FIG. 22A shows a member having a single width 1242, formed with a pair of lumen 1246, 1248 therein. This allows for the dual air pathways necessary to allow high pressure air to flow into the leftmost member, and lower pressure air to also flow down the leftmost member. The distinction between the members shown in FIGS. 22A and 22B is simply that FIG. 22A includes a member having the same width as the other members in Display 1200, whereas the member shown in FIG. 22B represents the placement of two single-width members to create a member 1249 having a double width 1244 and two lumens 1250, 1252. It is to be appreciated, however, that the formation or creation of these air passageways may be accomplished in many ways. For example, an air passageway may simply be created by routing a channel in the back surface of each acrylic sheet where the member attaches such that the attachment of a standard, non-lumened member will create a lumen between the member and the sheet.

As the air passes through member 1220, it passes through exhaust port 1226, through tube 1230, and into condenser 1232. Condenser 1234 provides for the condensation and collection of any moisture which passes through the low-pressure passageways, and may be drained periodically to ensure proper operation of the Display 1200. Once passed through condenser 1234, the air passes through filter 1236 where it is screened to eliminate any residual moisture before passing through tube 1240, and back into pump 1210 for recirculation from the system.

In addition to providing a condensing function, the condenser may also serve as a bladder, making volumetric adjustments to the air-volume within the Display 1200. For example, as the temperature of the Display changes, such as can be caused by exposure to the sunlight, the fluid within the Display changes its volume, occupying a larger volume. This larger volume of fluid, if there were no bladder, would create an extreme pressure within Display 1200, perhaps causing the acrylic panels to crack, or causing joints to weaken and/or leak. Additionally, atmospheric (or barometric) pressure would also cause changes in the pressure experienced by panel 1204. in any case, bladder (or condenser) 1232 may be formed of a substantially hollow chamber having semi-rigid sides which would change its volume to accommodated the pressure changes discussed herein, thereby eliminating the potential for damage to the Display 1200.

Figure 23:
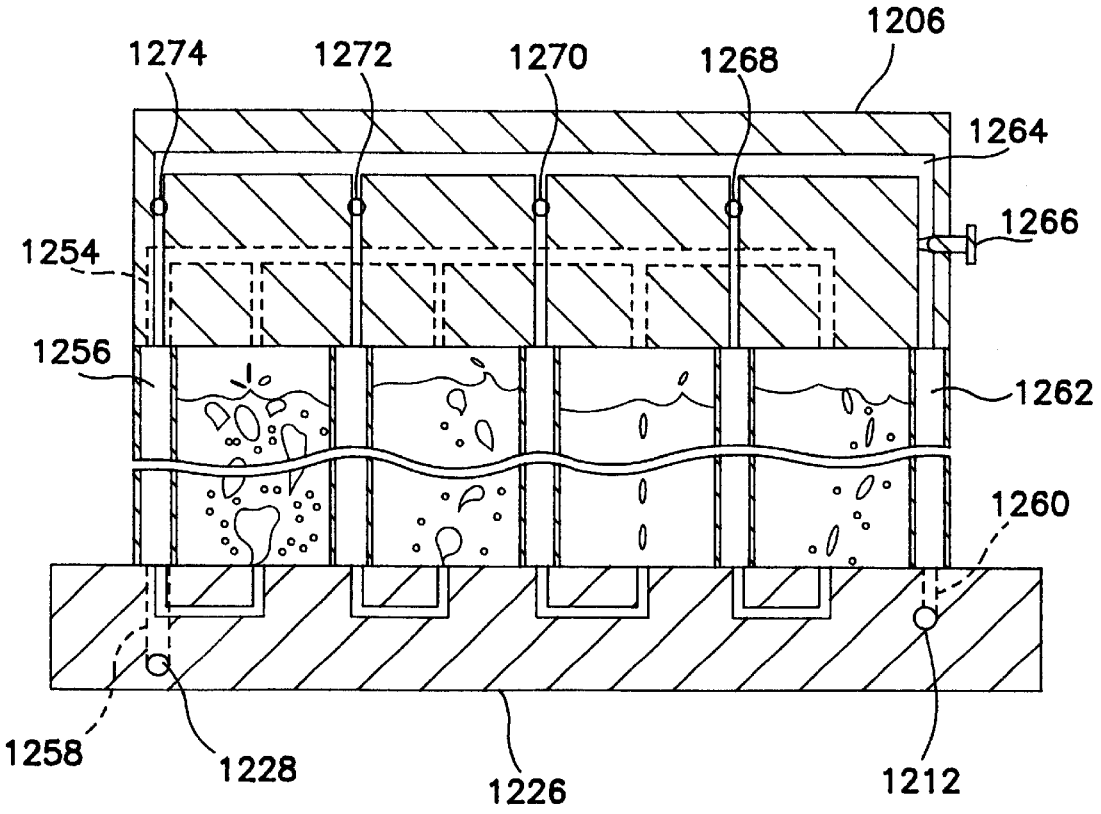

Referring now to FIG. 23, the Display of FIGS. 21, 22A and 22B is shown in cross-section. The upper plate 1206 is formed with a series of air passageways for the high-pressure and low-pressure air. Specifically, air is supplied to air passageway 1226 from pump 1210 through tube 1212. The air passes upwards into upper plate 1206, passing through flow valve 1266 formed by treading a hole into upper plate 1206 which passes through air passage 1264. By threading the screw portion of valve 1266 into upper plate 1206, the air flow through airway 1264 is impeded, thereby regulating the flow of the air into the chambers as discussed elsewhere herein. Similarly, each air supplying line for each chamber may also be equipped with a similar flow-control valve 1268, 1270, 1272, 1274, thereby providing for the independent regulation of the bubbles in each chamber. It should be appreciated, however, that the construction of the flow control valve 1266 is merely exemplary, and that any other means of regulating the flow of air into the chambers is fully contemplated herein.

The low-pressure air exiting the chambers through the dashed-line air passageways 1254, are passed down through member 1220 into bore 1258 in bottom plate 1226 for exiting the panel. In this manner, the Display 1200 is both a leak-proof and sealed system, providing for a Display which is both easy to manufacture, simple to construct, and requires less components than other Displays.

In an effort to further reduce the introduction of contamination into Display 1200, an air source (or generator) 1242 may be inserted in line with tube 1240 to further purify the air in Display 1200. Alternatively, different gases, or combinations of gasses, may be used in Display 1200 to further decrease the likelihood of contamination. For example, an ozone generator has been found to minimize the presence of contamination in Display 1200. Ozone is often used as a purification agent, and ozone generators are commercially available. Specifically, ozone generator 1242 generates substantially pure ozone. In general, ozone is usually prepared by passing an electric discharge through oxygen. Because of its powerful oxidizing properties, ozone is widely used for sterilizing water and for air purification.

In U.S. Pat. No. 4,764,349 ("'349 patent") which issued to Arff et al. for an invention entitled "Ozone Generator," and assigned to Ozotech, Inc. of Yreka, Calif., an ozone generator is described which uses high voltage to radiate energy through an elongated heat resistant glass tube filled with a gaseous substance, thereby producing ozone. The '349 patent is fully incorporated herein by reference. The device of the '349 patent produces a larger quantity of ozone than prior art ozone generators. An alternative family of ozone generators is also manufactured by Ozotech and sold under the "BTU" Series trade name. Of this family of ozone generators, the model OZ2BTU requires less than 1.0 amp of electrical current, and can produce up to 0.38 pounds per day of ozone. This high volume of ozone production suits the model OZ2BTU particularly well for the present invention, where it is sometimes necessary provide a large volume of ozone to create extremely large bubbles within the fluid. It should be noted, however, that the ozone generating devices described herein are merely representative of a number of equivalent devices currently available.

Figure 24:
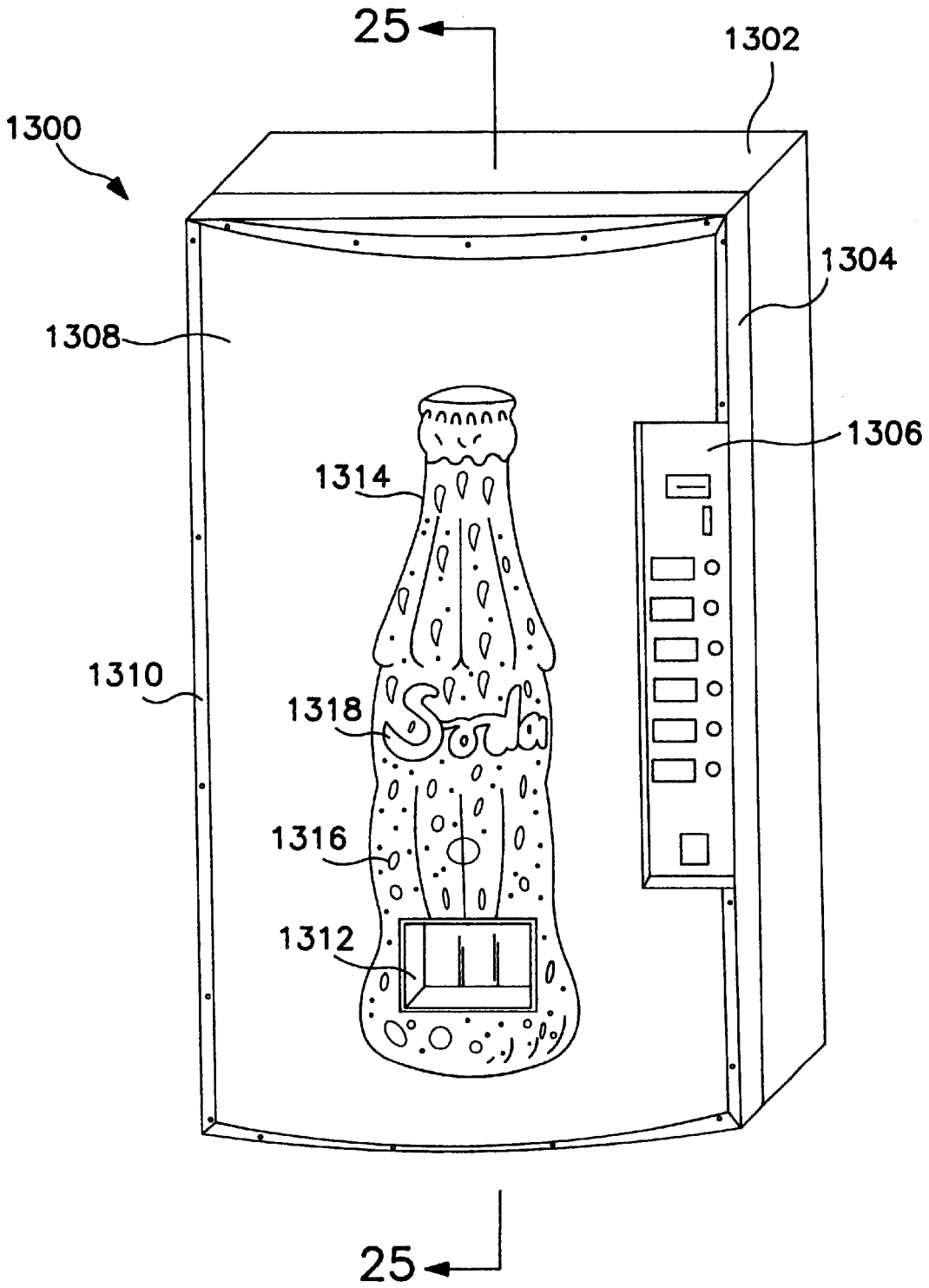
FIGS. 24 through 27 are a series of view showing a Bubbling Liquid Display of the present invention which includes a number of vending machines.

Referring now to FIG. 24, an alternative embodiment of the Bubbling Liquid Display of the present invention is shown and generally designated 1300. Display 1300 includes a vending machine 1302 having a door 1304 which contains a selection area 1306 for selecting a particular refreshment for a selection of refreshments dispensed through dispenser 1312 from within the vending machine 1302. Machine 1302 has a front panel 1308 which is held on door 1304 by detachable frame 1310 which is attached using screws, or other removable means, such as rivets.

Front panel 1308 is formed with a three-dimensional bottle 1314 extending from the face of the vending machine 1302. Bottle 1314 is made of a transparent material, such as acrylic, and is filled with bubbles 1316 such that the bubbles 1316 may be viewed by a person standing in front of the machine, such as a person deciding whether to purchase from the vending machine. Logo 1318 may be etched onto the face of bottle 1314, or the logo may be simply applied to the internal or externals surface of the bottle face such that it is easily viewed along with the bubbles 1316.

Figure 25:
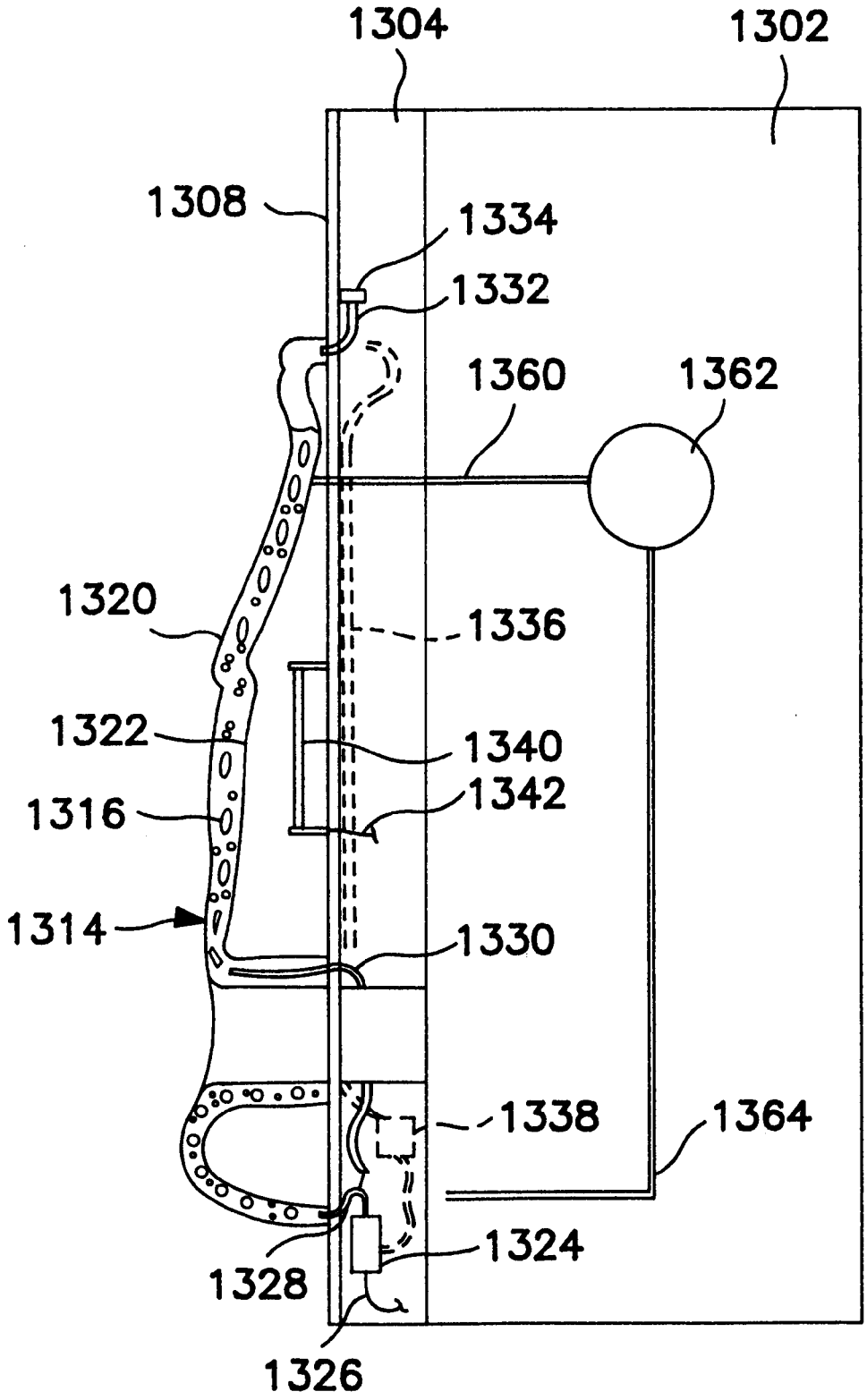

Referring to FIG. 25, the Display 1300 is shown in cross-section showing the extension of bottle 1314 out from the vending machine 1302. The bottle 1314 has an outer wall 1320 and an inner wall 1322, each substantially bottle shaped. However it should be noted that inner wall may be flat, conforming to the shape of a standard vending machine front panel, but such a configuration would require a larger volume of fluid.

Air pump 1324 attached to the inside of door 1304 and is attached to a source of electrical power from the vending machine 1302 via cord 1324. Compressed air is supplied to bottle 1314 through tubes 1328 and 1330. Specifically, the lower portion of the bottle underneath the dispenser 1312 is supplied with air from tube 1328. However, since dispenser 1312 prevents the bubbles from going directly upwards, a second source of air is supplied to bottle 1314 directly above the dispenser 1312 such that the entire bottle 1314 contains rising bubbles.

The air bubbles 1316 move upwards through bottle 1314 and exit through vent tube 1332 which may be attached to a filter 1334, or may be attached to a recirculation tube 1336 which recirculates the air from bottle 1314 through conditioner 1338. Conditioner 1338 may contain a filter and/or a condenser, and may even contain a cooler. A cooler would effectively cool the air which passes through the fluid within the bottle 1314 such that the fluid would thereby be cooled. The cool fluid would, when the surrounding atmospheric conditions are sufficiently warm, produce condensation on the outside of the bottle, making the bottle "sweat" thereby making the thought of purchasing a soda from the machine 1302 particularly appealing.

Alternatively, the bottle 1314 may be attached at its upper end to a outlet line 1360 such that warm fluid from within the bottle would rise and be drawn through line 1360 to a cooler 1362 and re-introduced into the lower end of the bottle through line 1364. Cooler 1362 may simply be a length of line 1360 which is passed through the refrigerated section of the vending machine 1302, and then re-introduced back to the bottle 1324. A fluid pump (not shown) may be used, but such pumps are well known in the art and are not discussed in detail here. Liquid and air Coolers are also well known in the art, and are therefore not discussed in detail here. Virtually any cooling device would be suitable for use in Display 1300, so long as the fluid or air is sufficiently cooled to provide the "sweating" action described herein.

Display 1300 may also include an illumination source, such as a neon, incandescent, or halogen light. Additionally, the fluid within bottle 1314 may be colored, such as to resemble a cola soda, or tinted yellow, green, red, etc. to resemble other commonly available beverages.

Figure 26:
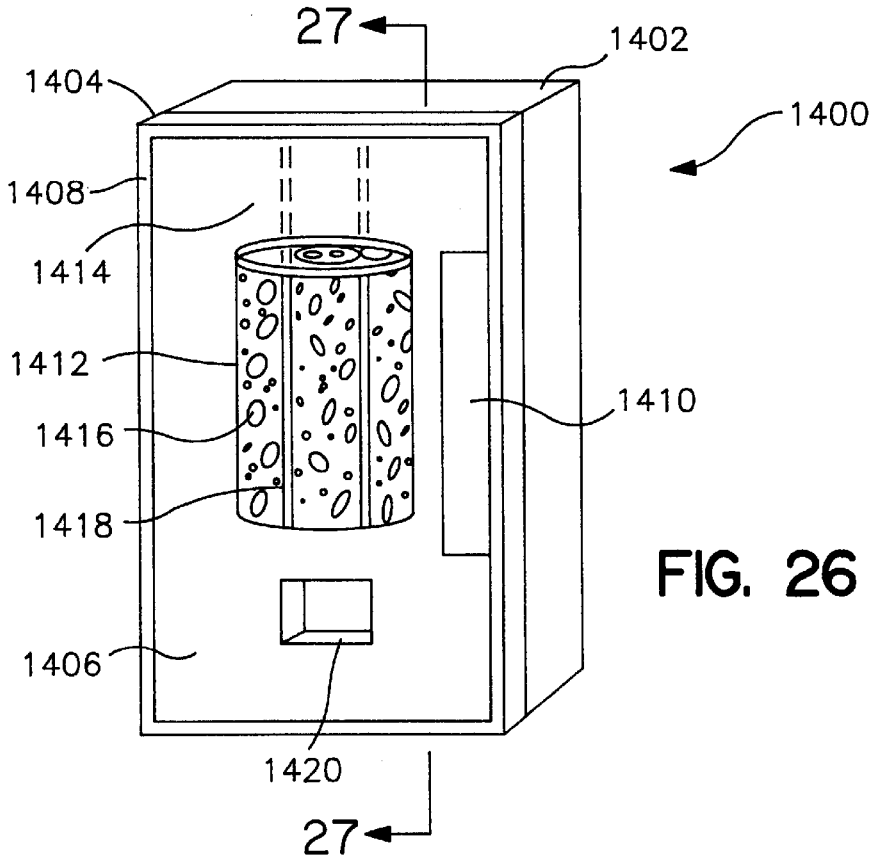

Referring now to FIG. 26, an alternative embodiment of the Bubbling Liquid Display of the present invention is shown and generally designated 1400. Display 1400 includes a conventional flat-paneled vending machine 1402 having a door 1404 with a front panel 1406 held in place with frame 1408. Machine 1402 is also formed with a selection area 1410.

Figure 27:
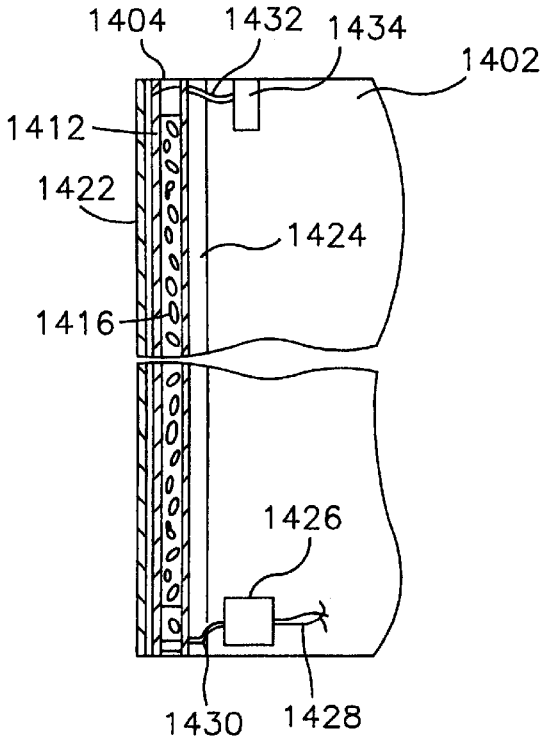

Front panel 1406 is made from a fluid filled display 1412 which may have ribs 1418, and may be formed with a cutout 1420 for dispensing the refreshments from the vending machine. Referring to FIG. 27, display 1412 is shown adjacent the inside surface of panel 1406 and is shown extending the height of the door 1404. It should be noted, however, that the height of the panel may be less then the entire height of the door, and may extend only from above the dispenser, if desired, simplifying the manufacturing process by eliminating the need for a cutout 1420.

Pump 1426 provides compressed air to panel 1412 through tube 1430, allowing the mounting of the pump inside the machine, thereby cooling the air as well as facilitating the mounting of the pump itself. The upper end of the display may have a vent tube 1432 and a filter 1434, but the air within the display may also be recirculated as described herein.

The front panel 1406 may be entirely transparent, providing for the viewing of the entire display, or the front panel may have an image printed thereon, such as the image of the cola can 1412, wherein the portion of the image of the can is substantially transparent, allowing for the visibility of the bubbles 1416 through panel 1406, while other portions of the panel may be substantially opaque. In any case, it should be appreciated that a vending machine panel may be partially, or completely, enhanced by the addition of a Bubbling Liquid Display described herein.

In addition to the front panels having fluid filled bubbling displays, it would be possible, and perhaps advantageous to provide an vending machine wherein every side is provided with a display such as those described herein.

The present invention also includes the method for retrofitting an existing vending machine to incorporate a fluid filled display. For example, Referring to FIGS. 24 and 25, the frame 1310 and original front panel may be taken off of machine 1302 by opening the door 1304 and removing the hardware which retains the frame. Once the original front panel is removed, the panel of the present invention is place against the front of the machine such that the cutout for selection area 1306 and dispenser 1312 are aligned. Once aligned, the frame 1310 is re-attached to secure the new front panel 1308 to machine 1302. Once secured, the pump is mounted to the inside of the machine, either on the inside of the door 1304, or on the body of the machine such that supply tubes 1328 and 1330 may be routed between the machine and door. Once the tubes are attached and the pump is mounted, the bottle 1314 is filled with fluid through port 1332 or through a sealable filler hole (not shown).

In addition to securing the front panel, the pump must be connected to an electrical source (preferably from within the vending machine), along with any auxiliary lighting desired. Such lighting, however, may not be necessary as most vending machines have existing lighting on the inside of their doors.

The front panel shown in FIGS. 24 and 25 has been formed by a heated vacuum-forming process well known in the art. However, it should be appreciated that, while the form of bottle 1314 is quite appropriate for a soda vending machine, any number of other shapes or forms can be used in conjunction with other vended products, and the bottle is to be considered merely exemplary.

Figure 28:
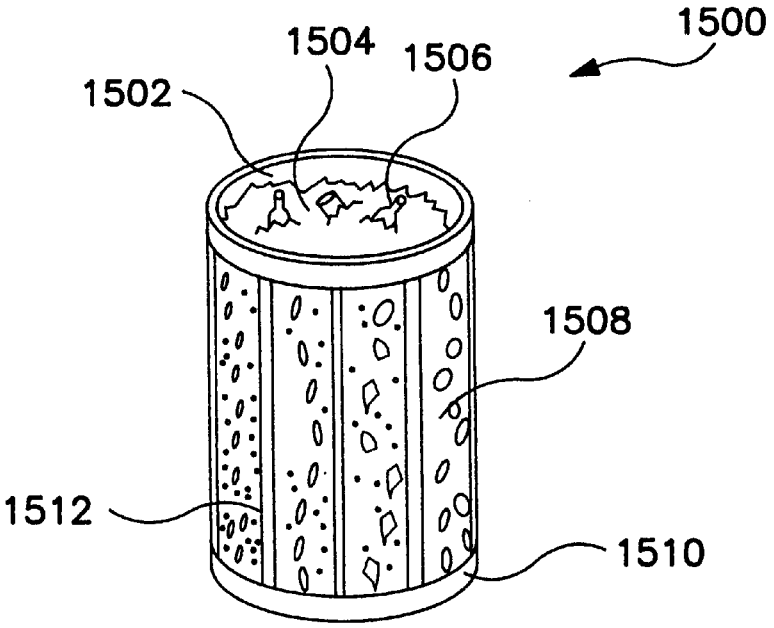
FIG. 28 is a Bubbling Liquid Display of the present invention which includes a point of purchase display.

Referring now to FIG. 28, another alternative embodiment of the Bubbling Liquid Display of the present invention is shown and generally designated 1500. Display 1500 contains a base 1510 which supports a display panel having a substantially cylindrical shape wherein the display panel 1508 defines a container 1502 at its uppermost end. This container, shown here filled with ice 1504, may be used as a point-of-purchase display for soda and beer, for example. Ribs 1512 are placed in display 1508 such that the extraordinary rising bubble effect described elsewhere herein is created, providing an even greater enticement to purchase the displayed product.

Figure 29:
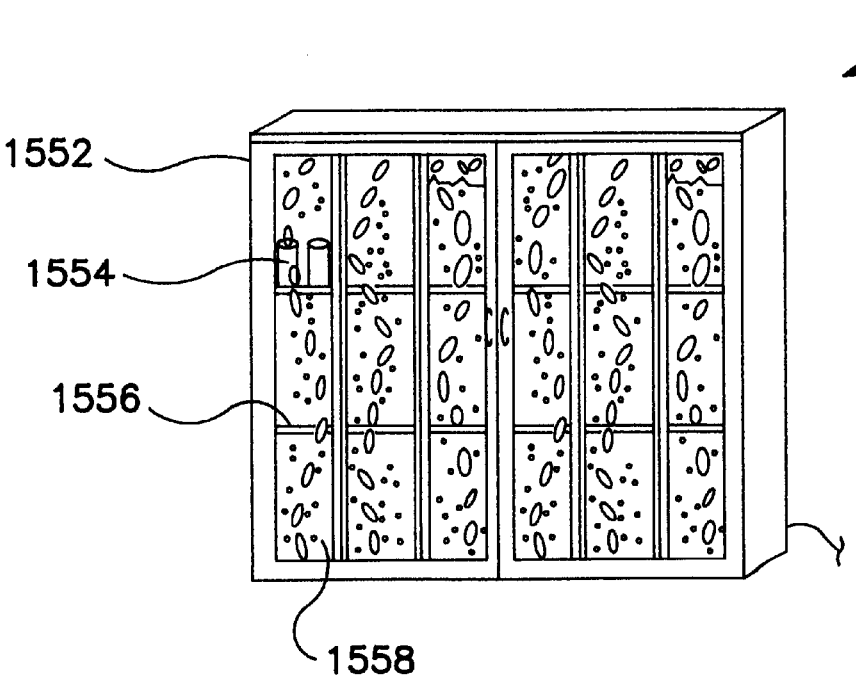
FIG. 29 is a Bubbling Liquid Display of the present invention which includes a refrigerated beverage case.

Referring now to FIG. 29, yet another alternative embodiment of the Bubbling Liquid Display of the present invention is shown and generally designated 1550. Display 1550 includes a standard commercial refrigerator which often is used to display and chill soda and beer, for example. Doors 1552 of the refrigerator are fitted with fluid filled display panels 1558 such that the contents of the refrigerator, such as bottles and cans 1554 sitting on shelves 1556 may be viewed from outside the refrigerator, through the fluid filled panels. The refrigerated nature of the environment of the Display 1550 would provide a natural condensation on the outside of the panels 1558, such as the effect described elsewhere herein.

Figure 30:
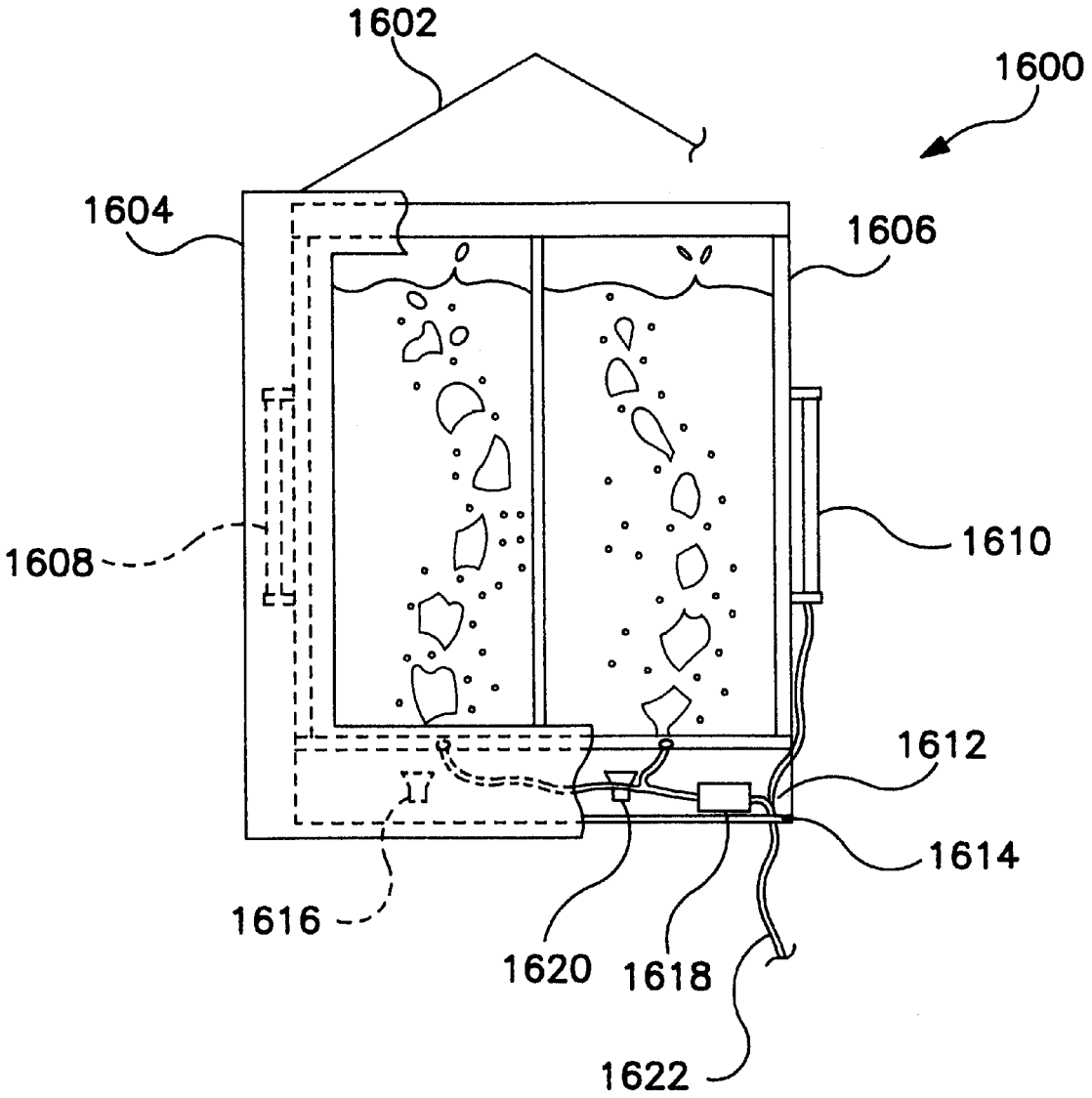
FIG. 30 is a a Bubbling Liquid Display of the present invention which includes a wall mounted display having side lights.

Referring now to FIG. 30, an alternative embodiment of the Bubbling Liquid Display of the present invention is shown and generally designated 1600. Display 1600 is configured to hang from a wall with cord 1602, or to be mounted on a wall using commonly available hangers. Display 1600 includes a frame 1604 which covers the edges of a fluid filled panel 1606 which may be equipped with side-mounted lights 1608 and 1610, such that the display is illuminated from the sides. Electrical wires 1622 from the lights pass through shelf 1614 extending perpendicularly from back plate 1612. Pump 1618 is located on shelf 1614 and provides compressed air to the chambers of panel 1606. Lights 1616 and 1618 may also be provided to provide greater illumination to the panel 1606.

For use as an advertisement device, the back surface of panel 1606 may be equipped with an advertisement brochure, logo, or other means for creating an enhanced impression of a product with the use of Display 1600. Display 1660 may also have a logo or image either etched to its front or back face, or simply be attached to the panel with adhesive. In any case, it should be appreciated that the Display 1600 can be adorned in many ways to create an innovative and extraordinary display.

Figure 31:
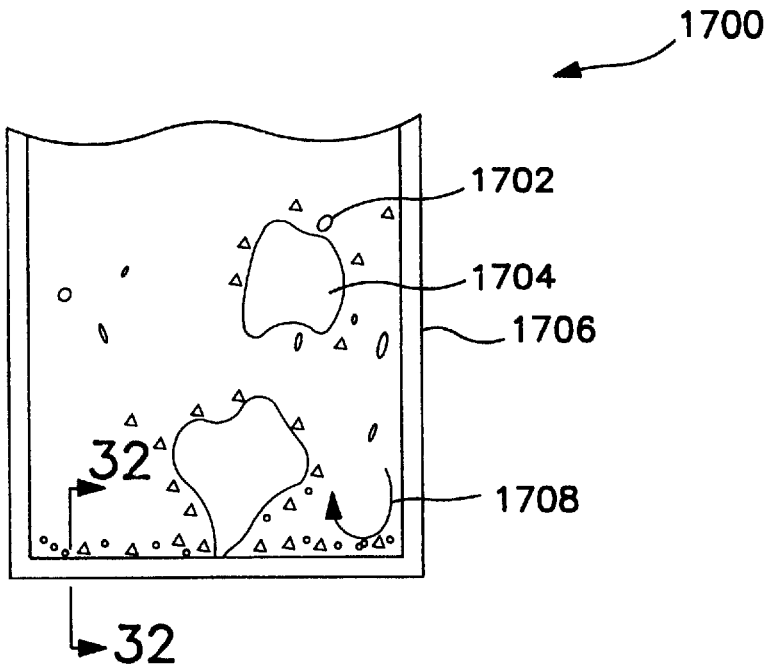
FIG. 31 is a a Bubbling Liquid Display of the present invention which includes a collection of reflective metallized particles which provide a distinct visual effect when combined with the bubble generating means described herein.
Figure 32:
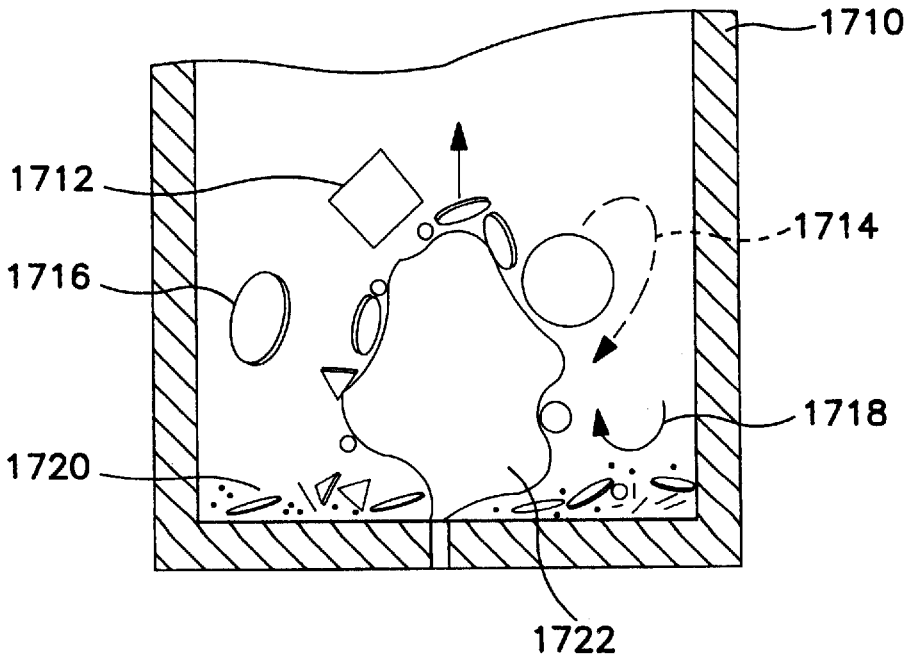

Referring now to FIGS. 31 and 32, yet another alternative embodiment of the Bubbling Liquid Display of the present invention is shown and generally designated 1700. Display 1700 includes a fluid filled panel 1706 which contains a number of small pieces of metalized polyethylene or polyester film which are substantially neutrally buoyant, and agitated and moved about within Display 1700 when bubbles are passed therethrough. A screen or filter may be provided at the opening of the air injectors at the bottom of the panel to prevent blockage of air supply tubes or check-valves when pumps are stopped, and the fluid is allowed to partially flow backwards into the air supply tubes.

The presence of these metallized, or otherwise reflective particles allows the Display 1700 to be easily seen in full illumination, such as if the display is used as a sign in broad daylight. Specifically, although the contrast between the bubbles and the fluid may be partially lost when the display is located in the sun, the movement of particles 1712 and 1716 are such that when bubble 1722 moves upwards, the particles move in a pathway, such as that shown by arrow 1714, such that the bright light, such as the sun, is reflected back to the viewer. Moreover, passage of the bubbles creates the circular currents 1718 which serves to raise the particles into the fluid from their resting place shown by particles 1720. The particles may have a variety of colors and shapes such that in situations where the illumination is normal, the particles themselves provide an interesting visual effect, combining the extraordinary bubbling motion described herein, with the color and sparkling effects of the particles.

It will be apparent to those skilled in the art that various modifications and variations can be made in the system of the present invention without departing from the spirit or scope of the invention. Thus, it is intended that the present invention cover the modifications and variations of this invention provided they come within the scope of the appended claims and their equivalence.

We claim:

1. A bubbling fluid display which comprises:

a panel which is formed with a plurality of chambers each said chamber having a lower closed end and an upper open end;

a fluid contained in each said chamber;

a plurality of air sources, each said air source of said plurality of air sources having an air flow volume;

a means for varying said air flow volume in each said air source of said plurality of air sources; and a plurality of supply tubes, each said supply tube of said plurality of supply tubes extending between and in fluid communication with one said lower closed end and one said air source wherein activation of each said air source injects air through one supply tube of said plurality of supply tubes and into the fluid within one said chamber to create a bubble therein.

2. The bubbling fluid display of claim 1, which further comprises:

a plurality of air flow valves, each said valve regulating the flow of air into each said chamber to create a unique bubbling pattern for each chamber.

3. The bubbling fluid display of claim 1, which further comprises:

a means to create large bubbles which move upwards within the fluid in the display, while also creating smaller bubbles which move downwards within the fluid in the display.

4. The bubbling fluid display of claim 1, which further comprises:

an illumination source positioned to illuminate said fluid within said chambers.

5. The bubbling fluid display of claim 4, which further comprises:

a translucent colorizing sheet positionable within said display between said illumination source and said chambers for the colored illumination of said chambers.

6. The bubbling fluid display of claim 4, which further comprises:

a translucent colorizing sheet which is easy to install and remove from the display.

7. The bubbling fluid display of claim 1, which further comprises:

a flow control valve; and a means for draining a single chamber at a time thereby eliminating the need to completely drain the display for maintenance.

8. The bubbling fluid display of claim 1, which further comprises:

a "u-tube"; and a means for resisting leakage and spillage, despite being tipped or knocked over.

9. The bubbling fluid display of claim 1, which further comprises:

a recirculation system which incorporates a fluid which resists evaporation, corrosion, and algae formation, despite being constantly bubbled or exposed to sunlight or other sources of heat.

10. The bubbling fluid display of claim 1, which further comprises:

an air recycling system that minimizes evaporation, corrosion, and algae formation.

11. The bubbling fluid display of claim 1, which further comprises:

injection of a bubble creating gas into a fluid that minimizes evaporation, corrosion, and algae formation, and decreases the need for replacing or treating the fluid.

12. The bubbling fluid display of claim 1, which further comprises:

a plurality of illumination sources; and a means for selectively varying the intensity of the illumination of each of the chambers within the display.

13. The bubbling fluid display of claim 1, which further comprises:

an overflow basin which, despite leakage of the chambers, prevents any fluid from exiting the display or coming in contact with any electrical components of the display.

14. The bubbling fluid display of claim 1, which further comprises:

a removable drawer to facilitate the maintenance, repair, and use of the display while providing the highest degree of safety.

15. The bubbling fluid display of claim 1, which further comprises:

a base which is constructed in such a manner so as to allow the interchangeability of a plurality of water-filled panels and bases to assemble a variety of displays having different visual characteristics.

* * * * *